US007843396B2

(12) United States Patent
Hill et al.

(10) Patent No.: US 7,843,396 B2
(45) Date of Patent: Nov. 30, 2010

(54) ANTENNAS FOR HANDHELD ELECTRONIC DEVICES WITH CONDUCTIVE BEZELS

(75) Inventors: Robert J. Hill, Salinas, CA (US); Robert W. Schlub, Campbell, CA (US); Ruben Caballero, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/564,803

(22) Filed: Sep. 22, 2009

(65) Prior Publication Data

US 2010/0007564 A1 Jan. 14, 2010

Related U.S. Application Data

(63) Continuation of application No. 11/821,192, filed on Jun. 21, 2007, now Pat. No. 7,612,725.

(51) Int. Cl.
*H01Q 1/24* (2006.01)

(52) U.S. Cl. ..... 343/702; 343/700 MS; 343/767; 343/846

(58) Field of Classification Search ..... 343/702, 343/700, 767, 829, 846
See application file for complete search history.

(56) References Cited

U.S. PATENT DOCUMENTS 2,942,263 A * 6/1960 Baldwin ..... 343/767
3,394,373 A * 7/1968 Makrancy ..... 342/104
4,894,663 A 1/1990 Urbish
4,980,694 A 12/1990 Hines
5,021,010 A 6/1991 Wright
5,041,838 A 8/1991 Liimatainen
5,048,118 A 9/1991 Brooks
5,061,943 A 10/1991 Rammos
5,408,241 A * 4/1995 Shattuck et al. ..... 343/700 MS (Continued)

FOREIGN PATENT DOCUMENTS

EP 1 286 413 2/2003

(Continued)

OTHER PUBLICATIONS

Hobson et al. U.S. Appl. No. 60/833,587, filed Jan. 5, 2007.

(Continued)

*Primary Examiner*—Tho G Phan
(74) *Attorney, Agent, or Firm*—Treyz Law Group; G. Victor Treyz; Nancy Y. Ru

(57) ABSTRACT

A handheld electronic device may be provided that contains wireless communications circuitry. The handheld electronic device may have a housing and a display. The display may be attached to the housing a conductive bezel. The handheld electronic device may have one or more antennas for supporting wireless communications. A ground plane in the handheld electronic device may serve as ground for one or more of the antennas. The ground plane and bezel may define a opening. A rectangular slot antenna or other suitable slot antenna may be formed from or within the opening. One or more antenna resonating elements may be formed above the slot. An electrical switch that bridges the slot may be used to modify the perimeter of the slot so as to tune the communications bands of the handheld electronic device.

16 Claims, 20 Drawing Sheets

U.S. PATENT DOCUMENTS

| | | | | |
|---|---|---|---|---|
| 5,561,437 | A | 10/1996 | Phillips | |
| 5,684,672 | A * | 11/1997 | Karidis et al. | 361/679.26 |
| 5,754,143 | A | 5/1998 | Warnagiris | |
| 5,798,984 | A | 8/1998 | Koch | |
| 6,011,699 | A | 1/2000 | Murray | |
| 6,031,503 | A * | 2/2000 | Preiss et al. | 343/770 |
| 6,097,345 | A | 8/2000 | Walton | |
| 6,282,433 | B1 | 8/2001 | Holshouser | |
| 6,337,662 | B1 | 1/2002 | Cassel | |
| 6,622,031 | B1 | 9/2003 | McCleary | |
| 6,670,923 | B1 | 12/2003 | Kadambi | |
| 6,741,214 | B1 | 5/2004 | Kadambi | |
| 6,747,601 | B2 | 6/2004 | Boyle | |
| 6,762,723 | B2 | 7/2004 | Nallo | |
| 6,825,811 | B2 * | 11/2004 | Iwai et al. | 343/702 |
| 6,856,294 | B2 | 2/2005 | Kadambi | |
| 6,968,508 | B2 | 11/2005 | Lucaci | |
| 6,980,154 | B2 | 12/2005 | Vance | |
| 7,027,838 | B2 | 4/2006 | Zhou | |
| 7,116,627 | B2 | 10/2006 | Yoo et al. | |
| 7,119,747 | B2 | 10/2006 | Lin | |
| 2002/0126236 | A1 | 9/2002 | Hiratsuka | |
| 2003/0107518 | A1 | 6/2003 | Li | |
| 2004/0017318 | A1 | 1/2004 | Annabi | |
| 2004/0145521 | A1 | 7/2004 | Hebron | |
| 2006/0055606 | A1 | 3/2006 | Boyle | |
| 2006/0097941 | A1 | 5/2006 | Bettner et al. | |
| 2006/0125703 | A1 | 6/2006 | Ma et al. | |
| 2007/0176843 | A1 | 8/2007 | Qureshi | |
| 2008/0231521 | A1 | 9/2008 | Anguera Pros et al. | |

FOREIGN PATENT DOCUMENTS

| | | |
|---|---|---|
| EP | 1 315 238 | 5/2003 |
| EP | 1 351 334 | 10/2003 |
| EP | 1401050 A | 3/2004 |
| WO | 02/078123 | 10/2002 |
| WO | 2004/001894 | 12/2003 |
| WO | 2005/109567 A | 11/2005 |
| WO | 2006/114771 | 11/2006 |
| WO | 2007/039668 | 4/2007 |

OTHER PUBLICATIONS

Schlub et al. U.S. Appl. No. 11/650,071, filed Jan. 4, 2007.

* cited by examiner

ANTENNAS FOR HANDHELD ELECTRONIC DEVICES WITH CONDUCTIVE BEZELS

This application is a continuation of patent application Ser. No. 11/821,192, filed Jun. 21, 2007 now U.S. Pat. No. 7,612,725, which is hereby incorporated by reference herein in its entirety.

BACKGROUND

This invention relates generally to wireless communications circuitry, and more particularly, to wireless communications circuitry for handheld electronic devices with conductive bezels.

Handheld electronic devices are becoming increasingly popular. Examples of handheld devices include handheld computers, cellular telephones, media players, and hybrid devices that include the functionality of multiple devices of this type.

Due in part to their mobile nature, handheld electronic devices are often provided with wireless communications capabilities. Handheld electronic devices may use wireless communications to communicate with wireless base stations. For example, cellular telephones may communicate using cellular telephone bands at 850 MHz, 900 MHz, 1800 MHz, and 1900 MHz (e.g., the main Global System for Mobile Communications or GSM cellular telephone bands). Handheld electronic devices may also use other types of communications links. For example, handheld electronic devices may communicate using the WiFi® (IEEE 802.11) band at 2.4 GHz and the Bluetooth® band at 2.4 GHz. Communications are also possible in data service bands such as the 3G data communications band at 2170 MHz band (commonly referred to as UMTS or Universal Mobile Telecommunications System).

To satisfy consumer demand for small form factor wireless devices, manufacturers are continually striving to reduce the size of components that are used in these devices. For example, manufacturers have made attempts to miniaturize the antennas used in handheld electronic devices.

A typical antenna may be fabricated by patterning a metal layer on a circuit board substrate or may be formed from a sheet of thin metal using a foil stamping process. Many devices use planar inverted-F antennas (PIFAs). Planar inverted-F antennas are formed by locating a planar resonating element above a ground plane. These techniques can be used to produce antennas that fit within the tight confines of a compact handheld device. With conventional handheld electronic devices, however, design compromises are made to accommodate compact antennas. These design compromises may include, for example, compromises related to antenna height above the ground plane, antenna efficiency, and antenna bandwidth. Moreover, constraints are often placed on the amount of metal that can be used in a handheld device and on the location of metal parts. These constraints can adversely affect device operation and device appearance.

It would therefore be desirable to be able to provide improved antennas for handheld electronic devices.

SUMMARY

In accordance with an embodiment of the present invention, a handheld electronic device with wireless communications circuitry is provided. The handheld electronic device may have cellular telephone, music player, or handheld computer functionality. The wireless communications circuitry may have one or more antennas. The antennas may be used to support wireless communications over data communications bands and cellular telephone communications bands.

The handheld electronic device may have a housing. The front face of the housing may have a display. The display may be a liquid crystal diode (LCD) display or other suitable display. A touch sensor may be integrated with the display to make the display touch sensitive.

A bezel may be used to attach the display to the housing. The bezel surrounds the periphery of the front face of the housing and holds the display against the housing. A gasket may be interposed between the bezel and the housing.

The bezel may be formed from stainless steel or other suitable conductive materials. A ground plane element in the housing may serve as antenna ground. The ground plane element may have a slot. The slot may be used to form a slot antenna or a hybrid antenna. In a hybrid antenna configuration, one or more antenna resonating elements, such as planar inverted-F antenna resonating elements, may be located above the slot. The bezel may be electrically connected to the ground plane element. The bezel may surround the slot while accommodating the antennas. This allows the bezel to provide structural support and to enhance the appearance and durability of the handheld electronic device. Even though the bezel surrounds the slot, proper operation of the antenna resonating elements that are formed above the slot is not disrupted.

The slot may be located in the center of the handheld electronic device or at one end of the handheld electronic device. A switch that bridges the slot may be placed in an open or closed position to adjust the perimeter of the slot and thereby tune the antennas.

Further features of the invention, its nature and various advantages will be more apparent from the accompanying drawings and the following detailed description of the preferred embodiments.

DETAILED DESCRIPTION

Figure 1:
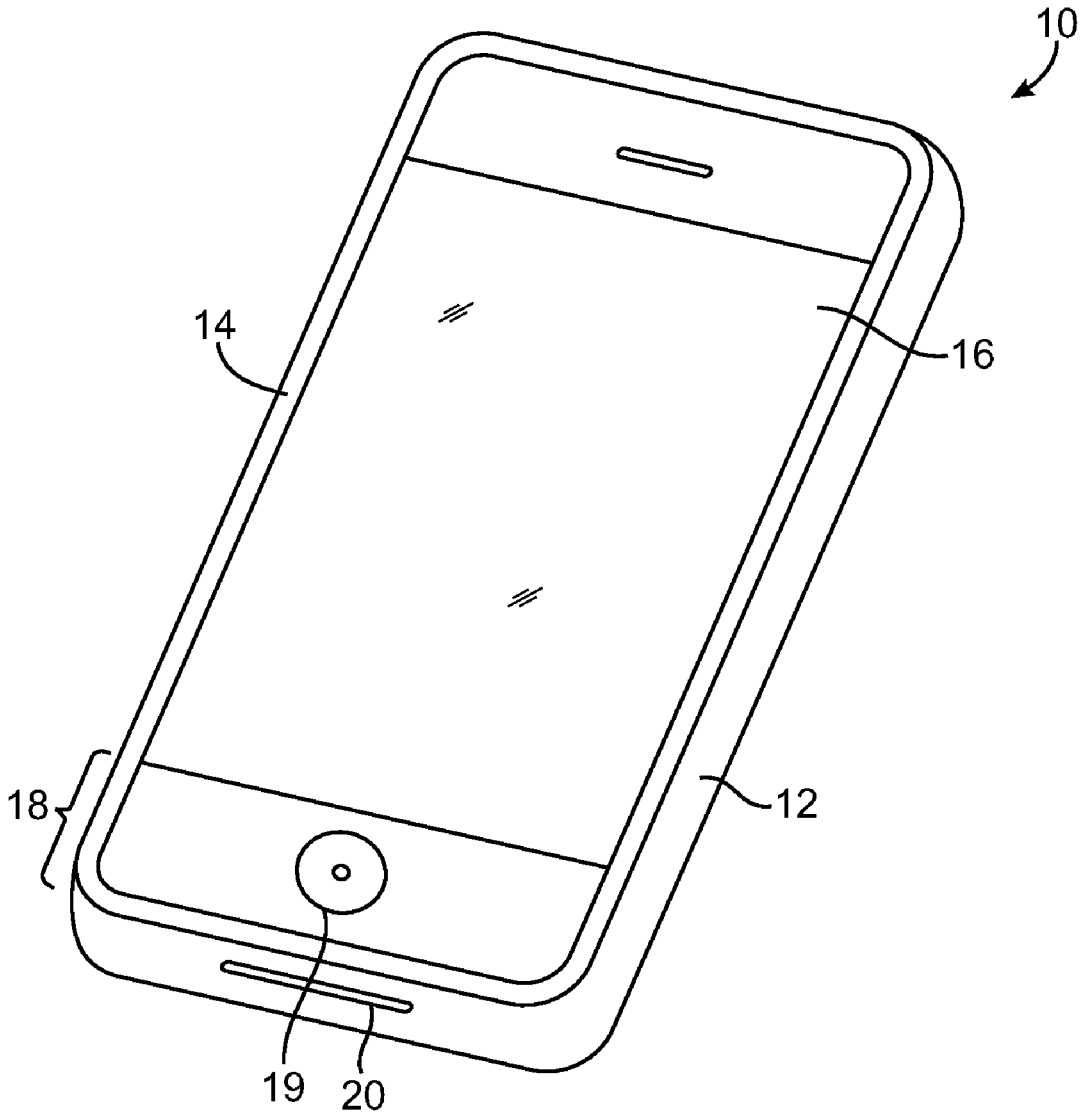
FIG. 1 is a perspective view of an illustrative handheld electronic device with an antenna in accordance with an embodiment of the present invention.

The present invention relates generally to wireless communications, and more particularly, to wireless electronic devices and antennas for wireless electronic devices.

The antennas may be small form factor antennas that exhibit wide bandwidths and large gains. In accordance with an illustrative embodiment of the present invention, the antennas are configured so that they accommodate a conductive bezel on the wireless electronic device. The bezel may serve as part of the antennas. For example, the bezel may form part of a ground for an antenna. The bezel may also perform mechanical functions such as providing structural strength for a wireless electronic device. With one suitable arrangement, which is described herein as an example, the bezel may hold a liquid crystal diode (LCD) display or other display to the surface of a wireless electronic device.

The wireless electronic devices may be portable electronic devices such as laptop computers or small portable computers of the type that are sometimes referred to as ultraportables. Portable electronic devices may also be somewhat smaller devices. Examples of smaller portable electronic devices include wrist-watch devices, pendant devices, headphone and earpiece devices, and other wearable and miniature devices.

With one suitable arrangement, the portable electronic devices are handheld electronic devices. Space is at a premium in handheld electronic devices, so high-performance compact antennas can be particularly advantageous in such devices. Handheld electronic devices may also benefit from the use of bezels. For example, a stainless steel bezel that surrounds the periphery of a handheld electronic device may serve several useful functions by increasing device rigidity, holding a glass or plastic faceplate for a display in place, enhancing the esthetic appeal of the device by serving as a visually appealing design element, and serving as a protective structure (e.g., to prevent a potentially fragile component such as a plastic or glass display from being damaged if the handheld electronic device is inadvertently dropped). The use of handheld devices is therefore generally described herein as an example, although any suitable electronic device may be used with the antennas and bezels of the invention if desired.

The handheld devices may be, for example, cellular telephones, media players with wireless communications capabilities, handheld computers (also sometimes called personal digital assistants), remote controllers, global positioning system (GPS) devices, and handheld gaming devices. The handheld devices may also be hybrid devices that combine the functionality of multiple conventional devices. Examples of hybrid handheld devices include a cellular telephone that includes media player functionality, a gaming device that includes a wireless communications capability, a cellular telephone that includes game and email functions, and a handheld device that receives email, supports mobile telephone calls, and supports web browsing. These are merely illustrative examples.

An illustrative handheld electronic device in accordance with an embodiment of the present invention is shown in FIG. 1. Device 10 may be any suitable portable or handheld electronic device.

Device 10 may have housing 12. Device 10 may include one or more antennas for handling wireless communications. Embodiments of device 10 that contain one antenna and embodiments of device 10 that contain two antennas are sometimes described herein as examples.

Device 10 may handle communications over one or more communications bands. For example, in a device 10 with two antennas, a first of the two antennas may be used to handle cellular telephone communications in one or more frequency bands, whereas a second of the two antennas may be used to handle data communications in a separate communications band. With one suitable arrangement, which is sometimes described herein as an example, the second antenna is configured to handle data communications in a communications band centered at 2.4 GHz (e.g., WiFi and/or Bluetooth frequencies). In configurations with multiple antennas, the antennas may be designed to reduce interference so as to allow the two antennas to operate in relatively close proximity to each other.

Housing 12, which is sometimes referred to as a case, may be formed of any suitable materials including, plastic, glass, ceramics, metal, or other suitable materials, or a combination of these materials. In some situations, housing 12 or portions of housing 12 may be formed from a dielectric or other low-conductivity material, so that the operation of conductive antenna elements that are located in proximity to housing 12 is not disrupted. In other situations, housing 12 or portions of housing 12 may be formed from metal elements. In scenarios in which housing 12 is formed from metal elements, one or more of the metal elements may be used as part of the antennas in device 10. For example, metal portions of housing 12 may be shorted to an internal ground plane in device 10 to create a larger ground plane element for that device 10.

Housing 12 may have a bezel 14. The bezel 14 may be formed from a conductive material. The conductive material may be a metal (e.g., an elemental metal or an alloy) or other suitable conductive materials. With one suitable arrangement, which is sometimes described herein as an example, bezel 14 may be formed from stainless steel. Stainless steel can be manufactured so that it has an attractive shiny appearance, is structurally strong, and does not corrode easily. If desired, other structures may be used to form bezel 14. For example, bezel 14 may be formed from plastic that is coated with a shiny coating of metal or other suitable substances. Arrangements in which bezel 14 is formed from a conductive metal such as stainless steel are often described herein as an example.

Bezel 14 may serve to hold a display or other device with a planar surface in place on device 10. As shown in FIG. 1, for example, bezel 14 may be used to hold display 16 in place by attaching display 16 to housing 12. Device 10 may have front and rear planar surfaces. In the example of FIG. 1, display 16 is shown as being formed as part of the planar front surface of device 10. The periphery of the front surface may be surrounded by a bezel, such as bezel 14. If desired, the periphery of the rear surface may be surrounded by a bezel (e.g., in a device with both front and rear displays).

Display 16 may be a liquid crystal diode (LCD) display, an organic light emitting diode (OLED) display, or any other suitable display. The outermost surface of display 16 may be formed from one or more plastic and glass layers. If desired, touch screen functionality may be integrated into display 16 or may be provided using a separate touch pad device. An advantage of integrating a touch screen into display 16 to make display 16 touch sensitive is that this type of arrangement can save space and reduce visual clutter.

In a typical arrangement, bezel 14 may have prongs (e.g., prongs with integrated threaded and/or unthreaded screw holes) that are used to secure bezel 14 to housing 12 and that are used to electrically connect bezel 14 to housing 12 and other conductive elements in device 10. The housing and other conductive elements form a ground plane for the antenna(s) in the handheld electronic device. A gasket (e.g., an o-ring formed from silicone or other compliant material, a polyester film gasket, etc.) may be placed between the underside of bezel 14 and the outermost surface of display 16. The gasket may help to relieve pressure from localized pressure points that might otherwise place stress on the glass or plastic cover of display 16. The gasket may also help to visually hide portions of the interior of device 10.

In addition to serving as a retaining structure for display 16, bezel 14 may serve as a rigid frame for device 10. In this capacity, bezel 14 may enhance the structural integrity of device 10. For example, bezel 14 may make device 10 more rigid along its length than would be possible if no bezel were used. Bezel 14 may also be used to improve the appearance of device 10. In configurations such as the one shown in FIG. 1 in which bezel 14 is formed around the periphery of a surface of device 10 (e.g., the periphery of the front face of device 10), bezel 14 may help to prevent damage to display 16 (e.g., by shielding display 16 from impact in the event that device 10 is dropped, etc.).

Display screen 16 (e.g., a touch screen) is merely one example of an input-output device that may be used with handheld electronic device 10. If desired, handheld electronic device 10 may have other input-output devices. For example, handheld electronic device 10 may have user input control devices such as button 19, and input-output components such as port 20 and one or more input-output jacks (e.g., for audio and/or video). Display screen 16 may be, for example, a liquid crystal display (LCD), an organic light-emitting diode (OLED) display, a plasma display, or multiple displays that use one or more different display technologies. In the example of FIG. 1, display screen 16 is shown as being mounted on the front face of handheld electronic device 10, but display screen 16 may, if desired, be mounted on the rear face of handheld electronic device 10, on a side of device 10, on a flip-up portion of device 10 that is attached to a main body portion of device 10 by a hinge (for example), or using any other suitable mounting arrangement. Bezels such as bezel 14 of FIG. 1 may be used to mount display 16 or any other device with a planar surface to housing 12 in any of these locations.

A user of handheld device 10 may supply input commands using user input interface devices such as button 19 and touch screen 16. Suitable user input interface devices for handheld electronic device 10 include buttons (e.g., alphanumeric keys, power on-off, power-on, power-off, and other specialized buttons, etc.), a touch pad, pointing stick, or other cursor control device, a microphone for supplying voice commands, or any other suitable interface for controlling device 10. Although shown schematically as being formed on the top face of handheld electronic device 10 in the example of FIG. 1, buttons such as button 19 and other user input interface devices may generally be formed on any suitable portion of handheld electronic device 10. For example, a button such as button 19 or other user interface control may be formed on the side of handheld electronic device 10. Buttons and other user interface controls can also be located on the top face, rear face, or other portion of device 10. If desired, device 10 can be controlled remotely (e.g., using an infrared remote control, a radio-frequency remote control such as a Bluetooth remote control, etc.).

Handheld device 10 may have ports such as bus connector 20 and audio and video jacks that allow device 10 to interface with external components. Typical ports include power jacks to recharge a battery within device 10 or to operate device 10 from a direct current (DC) power supply, data ports to exchange data with external components such as a personal computer or peripheral, audio-visual jacks to drive headphones, a monitor, or other external audio-video equipment, etc. The functions of some or all of these devices and the internal circuitry of handheld electronic device 10 can be controlled using input interface devices such as touch screen display 16.

Components such as display 16 and other user input interface devices may cover most of the available surface area on the front face of device 10 (as shown in the example of FIG. 1) or may occupy only a small portion of the front face of device 10. Because electronic components such as display 16 often contain large amounts of metal (e.g., as radio-frequency shielding), the location of these components relative to the antenna elements in device 10 should generally be taken into consideration. Suitably chosen locations for the antenna elements and electronic components of the device will allow the antennas of handheld electronic device 10 to function properly without being disrupted by the electronic components.

With one suitable arrangement, the antennas of device 10 are located in the lower end 18 of device 10, in the proximity of port 20. An advantage of locating antennas in the lower portion of housing 12 and device 10 is that this places the antennas away from the user's head when the device 10 is held to the head (e.g., when talking into a microphone and listening to a speaker in the handheld device as with a cellular telephone). This reduces the amount of radio-frequency radiation that is emitted in the vicinity of the user and minimizes proximity effects.

Figure 2:
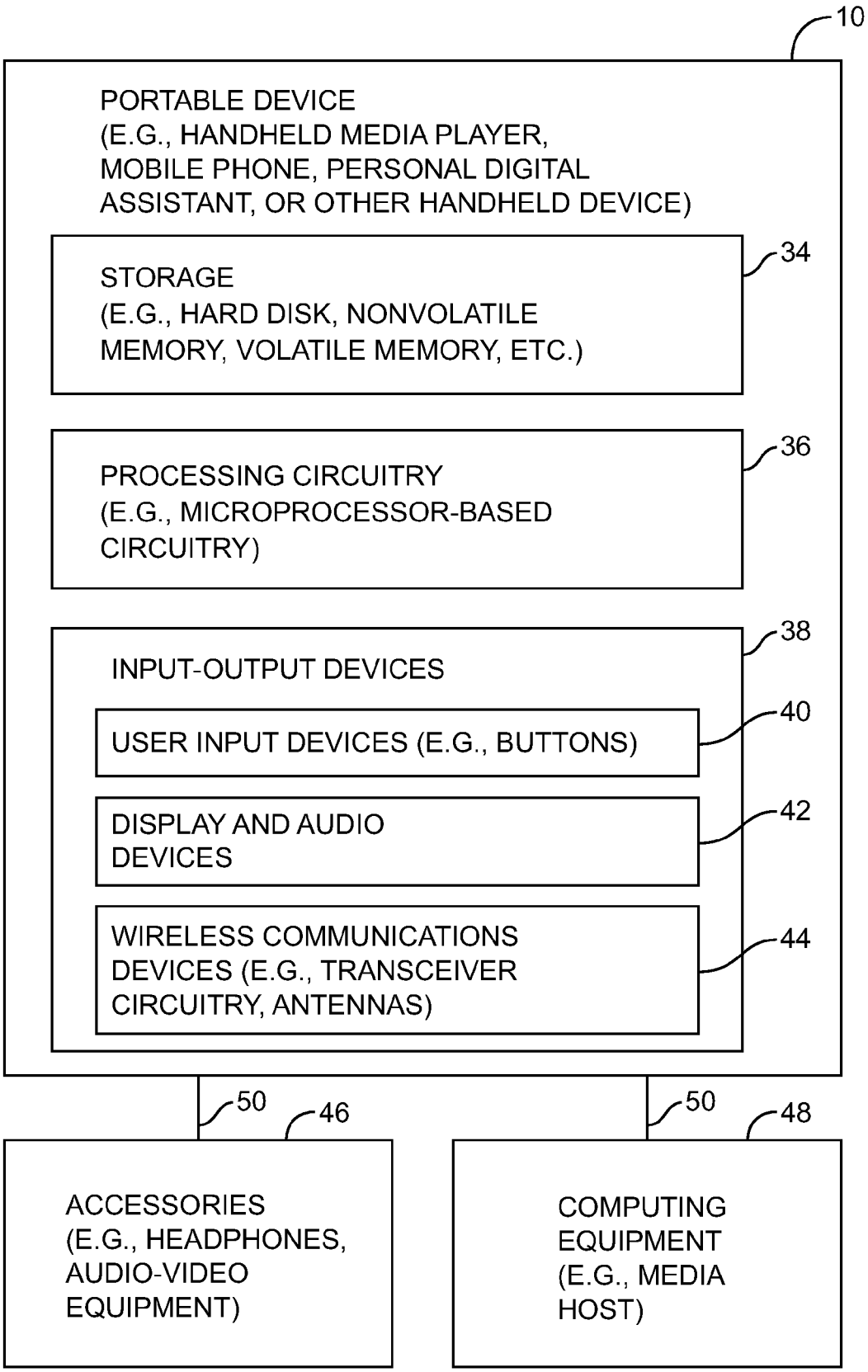
FIG. 2 is a schematic diagram of an illustrative handheld electronic device with an antenna in accordance with an embodiment of the present invention.

A schematic diagram of an embodiment of an illustrative handheld electronic device is shown in FIG. 2. Handheld device 10 may be a mobile telephone, a mobile telephone with media player capabilities, a handheld computer, a remote control, a game player, a global positioning system (GPS) device, a combination of such devices, or any other suitable portable electronic device.

As shown in FIG. 2, handheld device 10 may include storage 34. Storage 34 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 36 may be used to control the operation of device 10. Processing circuitry 36 may be based on a processor such as a microprocessor and other suitable integrated circuits. With one suitable arrangement, processing circuitry 36 and storage 34 are used to run software on device 10, such as internet browsing applications, voice-over-internet-protocol (VOIP) telephone call applications, email applications, media playback applications, operating system functions, etc. Processing circuitry 36 and storage 34 may be used in implementing suitable communications protocols. Communications protocols that may be implemented using processing circuitry 36 and storage 34 include internet protocols, wireless local area network protocols (e.g., IEEE 802.11 protocols—sometimes referred to as WiFi®, protocols for other short-range wireless communications links such as the Bluetooth® protocol, etc.).

Input-output devices 38 may be used to allow data to be supplied to device 10 and to allow data to be provided from device 10 to external devices. Display screen 16, button 19, and port 20 are examples of input-output devices 38.

Input-output devices 38 can include user input-output devices 40 such as buttons, touch screens, joysticks, click wheels, scrolling wheels, touch pads, key pads, keyboards, microphones, cameras, etc. A user can control the operation of device 10 by supplying commands through user input devices 40. Display and audio devices 42 may include liquid-crystal display (LCD) screens or other screens, light-emitting diodes (LEDs), and other components that present visual information and status data. Display and audio devices 42 may also include audio equipment such as speakers and other devices for creating sound. Display and audio devices 42 may contain audio-video interface equipment such as jacks and other connectors for external headphones and monitors.

Wireless communications devices 44 may include communications circuitry such as radio-frequency (RF) transceiver circuitry formed from one or more integrated circuits, power amplifier circuitry, passive RF components, one or more antennas, and other circuitry for handling RF wireless signals. Wireless signals can also be sent using light (e.g., using infrared communications).

Device 10 can communicate with external devices such as accessories 46 and computing equipment 48, as shown by paths 50. Paths 50 may include wired and wireless paths. Accessories 46 may include headphones (e.g., a wireless cellular headset or audio headphones) and audio-video equipment (e.g., wireless speakers, a game controller, or other equipment that receives and plays audio and video content).

Computing equipment 48 may be any suitable computer. With one suitable arrangement, computing equipment 48 is a computer that has an associated wireless access point (router) or an internal or external wireless card that establishes a wireless connection with device 10. The computer may be a server (e.g., an internet server), a local area network computer with or without internet access, a user's own personal computer, a peer device (e.g., another handheld electronic device 10), or any other suitable computing equipment.

The antennas and wireless communications devices of device 10 may support communications over any suitable wireless communications bands. For example, wireless communications devices 44 may be used to cover communications frequency bands such as the cellular telephone bands at 850 MHz, 900 MHz, 1800 MHz, and 1900 MHz, data service bands such as the 3G data communications band at 2170 MHz band (commonly referred to as UMTS or Universal Mobile Telecommunications System), the WiFi® (IEEE 802.11) bands at 2.4 GHz and 5.0 GHz, the Bluetooth® band at 2.4 GHz, and the global positioning system (GPS) band at 1550 MHz. These are merely illustrative communications bands over which devices 44 may operate. Additional local and remote communications bands are expected to be deployed in the future as new wireless services are made available. Wireless devices 44 may be configured to operate over any suitable band or bands to cover any existing or new services of interest. Device 10 may use one antenna, two antennas, or more than two antennas to provide wireless coverage over all communications bands of interest.

Figure 3A:
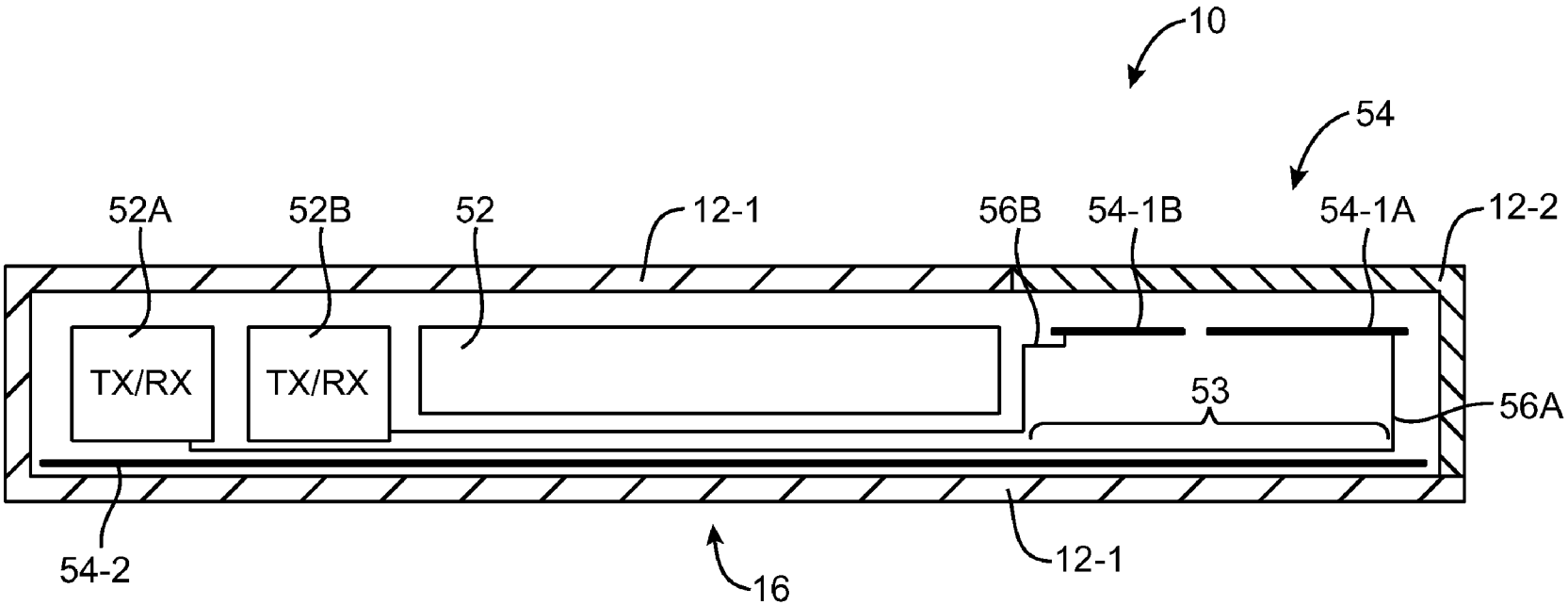
FIG. 3A is a cross-sectional side view of an illustrative handheld electronic device with an antenna in accordance with an embodiment of the present invention.

A cross-sectional view of an illustrative handheld electronic device is shown in FIG. 3A. In the example of FIG. 3A, device 10 has a housing that is formed of a conductive portion 12-1 and a plastic portion 12-2. Conductive portion 12-1 may be any suitable conductor. With one suitable arrangement, portion 12-1 is formed from metals such as stamped 304 stainless steel. Stainless steel has a high conductivity and can be polished to a high-gloss finish so that it has an attractive appearance. If desired, other metals can be used for portion 12-1 such as aluminum, magnesium, titanium, alloys of these metals and other metals, etc. As shown in FIG. 1, display 16 may be formed on the front surface of device 10. To accommodate display 16, housing portion 12-1 (the lower portion of the case in the orientation of FIG. 3A) may have a cut out portion that is surrounded by bezel 14.

In the illustrative embodiment of FIG. 3A, housing portion 12-2 may be formed from a dielectric. An advantage of using dielectric for housing portion 12-2 is that this may allow one or more antenna resonating elements such as antenna resonating elements 54-1A and 54-1B of antenna 54 in device 10 to operate without interference from the metal sidewalls of housing 12. With one suitable arrangement, housing portion 12-2 is a plastic cap formed from a plastic based on acrylonitrile-butadiene-styrene copolymers (sometimes referred to as ABS plastic). These are merely illustrative housing materials for device 10. For example, the housing of device 10 may be formed substantially from plastic or other dielectrics, substantially from metal or other conductors, or from any other suitable materials or combinations of materials.

Components such as components 52 may be mounted on one or more circuit boards in device 10. Typical components 52 include integrated circuits, LCD screens, and user input interface buttons. Device 10 also typically includes a battery, which may be mounted along the rear face of housing 12 (as an example). One or more transceiver circuits such as transceiver circuits 52A and 52B may be mounted to one or more circuit boards in device 10. In a configuration for device 10 in which there are two antenna resonating elements and two transceivers, each transceiver may be used to transmit radio-frequency signals through a respective one of two respective antenna resonating elements and may be used to receive radio-frequency signals through a respective one of two antenna resonating elements. A common ground may be used with each of the two antenna resonating elements.

With one illustrative arrangement, transceiver 52A may be used to transmit and receive cellular telephone radio-frequency signals and transceiver 52B may be used to transmit signals in a communications band such as the 3G data communications band at 2170 MHz band (commonly referred to as UMTS or Universal Mobile Telecommunications System), the WiFi® (IEEE 802.11) bands at 2.4 GHz and 5.0 GHz, the Bluetooth® band at 2.4 GHz, or the global positioning system (GPS) band at 1550 MHz.

The circuit board(s) in device 10 may be formed from any suitable materials. With one illustrative arrangement, device 10 is provided with a multilayer printed circuit board. At least one of the layers may have large planar regions of conductor that form a ground plane such as ground plane 54-2. In a typical scenario, ground plane 54-2 is a rectangle that conforms to the generally rectangular shape of housing 12 and device 10 and matches the rectangular lateral dimensions of housing 12. Ground plane 54-2 may, if desired, be electrically connected to conductive housing portion 12-1. Ground plane 54-2 may have an opening in the form of a slot in the vicinity of antenna 54. The opening may be formed by the shape and relative placement of the printed circuit boards, battery, integrated circuits, and other conductive components that make up the ground plane and/or may be formed by the shape and relative placement of these ground plane components relative to bezel 14. For example, ground plane 54-2 may have a slot in region 53 (e.g., a slot in a printed circuit board), beneath resonating elements such as resonating elements 54-1B and 54-1A. A rectangular slot (or other suitably shaped opening) may also be formed in the space between bezel 14 and ground plane 54-2. The slot may have any suitable shape. Illustrative slot shapes include rectangles, squares, ovals, shapes with both flat and curved sides, etc.

Suitable circuit board materials for the multilayer printed circuit board include paper impregnated with phonolic resin, resins reinforced with glass fibers such as fiberglass mat impregnated with epoxy resin (sometimes referred to as FR-4), plastics, polytetrafluoroethylene, polystyrene, polyimide, and ceramics. Circuit boards fabricated from materials such as FR-4 are commonly available, are not cost-prohibitive, and can be fabricated with multiple layers of metal (e.g., four layers). So-called flex circuits, which are formed using flexible circuit board materials such as polyimide, may also be used in device 10. For example, flex circuits may be used to form the antenna resonating elements for antenna(s) 54.

As shown in the illustrative configuration of FIG. 3A, ground plane element 54-2 and antenna resonating element 54-1A may form a first antenna for device 10. Ground plane element 54-2 and antenna resonating element 54-1B may form a second antenna for device 10. These two antennas form a multiband antenna having multiple resonating elements. If desired, other antenna structures can be provided. For example, additional resonating elements may be used to provide additional gain for an overlapping frequency band of interest (i.e., a band at which one of these antennas 54 is operating) or may be used to provide coverage in a different frequency band of interest (i.e., a band outside of the range of antennas 54).

Bezel 14 may be formed from a conductive material and may be mounted on device 10 in the vicinity of ground elements such as ground plane element 54-2. Bezel 14 may be electrically connected to the antenna ground (e.g., to ground plane element 54-2). When bezel 14 is connected to antenna ground, bezel 14 forms part of the ground and thereby serves as a portion of antenna 54.

Any suitable conductive materials may be used to form bezel 14, ground plane element 54-2, and resonating elements such as resonating element 54-1A and 54-1B. Examples of suitable conductive antenna materials include metals, such as copper, brass, silver, gold, and stainless steel (e.g., for bezel 14). Conductors other than metals may also be used, if desired. The planar conductive elements in antennas 54 are typically thin (e.g., about 0.2 mm).

Transceiver circuits 52A and 52B (i.e., transceiver circuitry 44 of FIG. 2) may be provided in the form of one or more integrated circuits and associated discrete components (e.g., filtering components). These transceiver circuits may include one or more transmitter integrated circuits, one or more receiver integrated circuits, switching circuitry, amplifiers, etc. Transceiver circuits 52A and 52B may operate simultaneously (e.g., one can transmit while the other receives, both can transmit at the same time, or both can receive simultaneously).

Each transceiver may have an associated coaxial cable or other transmission line over which transmitted and received radio frequency signals are conveyed. As shown in the example of FIG. 3A, transmission line 56A (e.g., a coaxial cable) may be used to interconnect transceiver 52A and antenna resonating element 54-1A and transmission line 56B (e.g., a coaxial cable) may be used to interconnect transceiver 52B and antenna resonating element 54-1B. With this type of configuration, transceiver 52B may handle WiFi transmissions over an antenna formed from resonating element 54-1B and ground plane 54-2, while transceiver 52A may handle cellular telephone transmission over an antenna formed from resonating element 54-1A and ground plane 54-2.

Figure 3B:
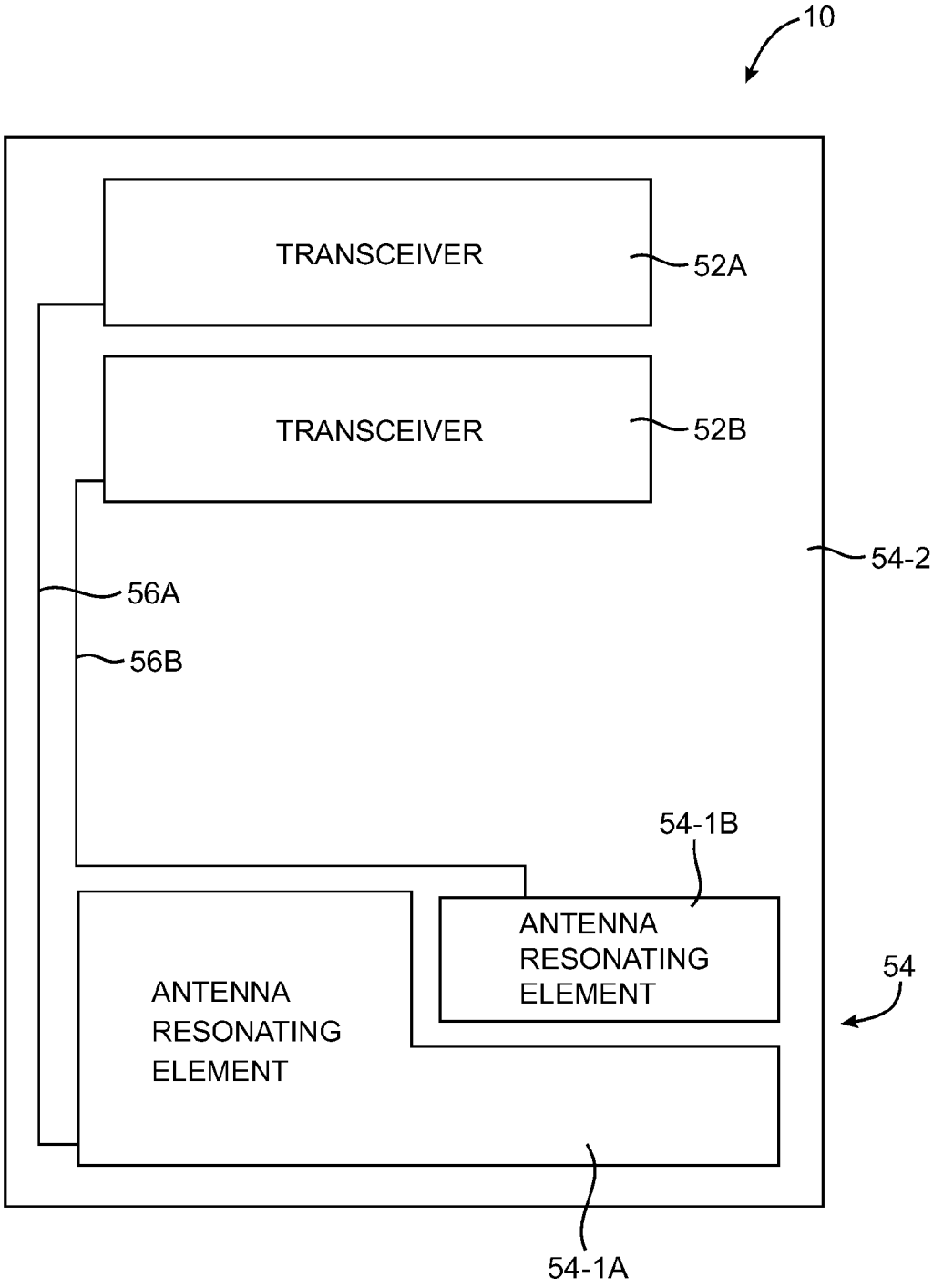
FIG. 3B is a partly schematic top view of an illustrative handheld electronic device containing two radio-frequency transceivers that are coupled to two associated antenna resonating elements by respective transmission lines in accordance with an embodiment of the present invention.

A top view of an illustrative device 10 in accordance with an embodiment of the present invention is shown in FIG. 3B. As shown in FIG. 3B, transceiver circuitry such as transceiver 52A and transceiver 52B may be interconnected with antenna resonating elements 54-1A and 54-1B over respective transmission lines 56A and 56B. Ground plane 54-2 may have a substantially rectangular shape (i.e., the lateral dimensions of ground plane 54-2 may match those of device 10) and may contain at least one slot (e.g., a slot under the antenna resonating elements). Ground plane element 54-2 may be formed from one or more printed circuit board conductors, conductive housing portions (e.g., housing portion 12-1 of FIG. 3A), conductive components such as display 16, batteries, or any other suitable conductive structure. Bezel 14 may be electrically connected to ground plane 54-2 and may therefore sometimes be considered to form part of the antenna ground plane.

Antenna resonating elements such as resonating elements 54-1A and 54-1B and ground plane 54-2 may be formed in any suitable shapes. With one illustrative arrangement, one of antennas 54 (i.e., the antenna formed from resonating element 54-1A) is based at least partly on a planar inverted-F antenna (PIFA) structure and the other antenna (i.e., the antenna formed from resonating element 54-1B) is based on a planar strip configuration. Although this embodiment may be described herein as an example, any other suitable shapes may be used for resonating elements 54-1A and 54-1B if desired.

Figure 4:
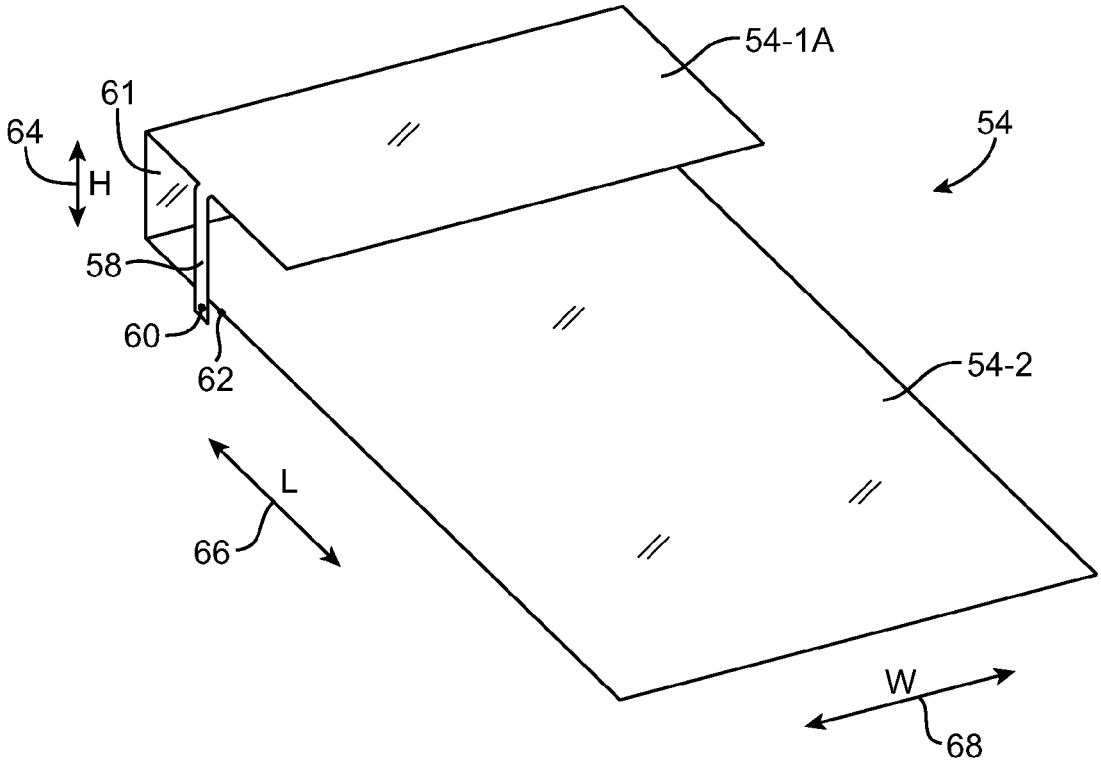
FIG. 4 is a perspective view of an illustrative planar inverted-F antenna (PIFA) in accordance with an embodiment of the present invention.

An illustrative PIFA structure is shown in FIG. 4. As shown in FIG. 4, PIFA structure 54 may have a ground plane portion 54-2 and a planar resonating element portion 54-1A. Antennas are fed using positive signals and ground signals. The portion of an antenna to which the positive signal is provided is sometimes referred to as the antenna's positive terminal or feed terminal. This terminal is also sometimes referred to as the signal terminal or the center-conductor terminal of the antenna. The portion of an antenna to which the ground signal is provided may be referred to as the antenna's ground, the antenna's ground terminal, the antenna's ground plane, etc. In antenna 54 of FIG. 4, feed conductor 58 is used to route positive antenna signals from signal terminal 60 into antenna resonating element 54-1A. Ground terminal 62 is shorted to ground plane 54-2, which forms the antenna's ground.

The dimensions of the ground plane in a PIFA antenna such as antenna 54 of FIG. 4 are generally sized to conform to the maximum size allowed by housing 12 of device 10. Antenna ground plane 54-2 may be rectangular in shape having width W in lateral dimension 68 and length L in lateral dimension 66. The length of antenna 54 in dimension 66 affects its frequency of operation. Dimensions 68 and 66 are sometimes referred to as horizontal dimensions. Resonating element 54-1A is typically spaced several millimeters above ground plane 54-2 along vertical dimension 64. The size of antenna 54 in dimension 64 is sometimes referred to as height H of antenna 54.

Figure 5:
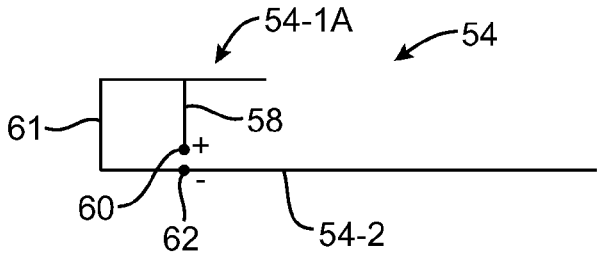
FIG. 5 is a cross-sectional side view of an illustrative planar inverted-F antenna of the type shown in FIG. 4 in accordance with an embodiment of the present invention.

A cross-sectional view of PIFA antenna 54 of FIG. 4 is shown in FIG. 5. As shown in FIG. 5, radio-frequency signals may be fed to antenna 54 (when transmitting) and may be received from antenna 54 (when receiving) using signal terminal 60 and ground terminal 62. In a typical arrangement, a coaxial conductor or other transmission line has its center conductor electrically connected to point 60 and its ground conductor electrically connected to point 62.

Figure 6:
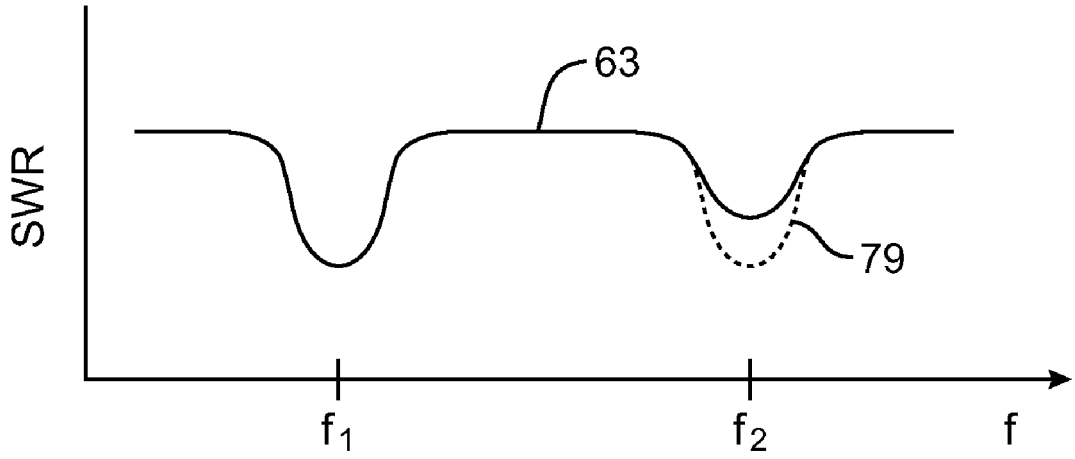
FIG. 6 is an illustrative antenna performance graph for an antenna of the type shown in FIGS. 4 and 5 in which standing-wave-ratio (SWR) values are plotted as a function of operating frequency in accordance with an embodiment of the present invention.

A graph of the expected performance of an antenna of the type represented by illustrative antenna 54 of FIGS. 4 and 5 is shown in FIG. 6. Expected standing wave ratio (SWR) values are plotted as a function of frequency. The performance of antenna 54 of FIGS. 4 and 5 is given by solid line 63. As shown, there is a reduced SWR value at frequency $f_1$, indicating that the antenna performs well in the frequency band centered at frequency $f_1$. PIFA antenna 54 also operates at harmonic frequencies such as frequency $f_2$. Frequency $f_2$ represents the second harmonic of PIFA antenna 54 (i.e., $f_2=2f_1$). The dimensions of antenna 54 may be selected so that frequencies $f_1$ and $f_2$ are aligned with communication bands of interest. The frequency $f_1$ (and harmonic frequency $2f_1$) are related to the length L of antenna 54 in dimension 66 (L is approximately equal to one quarter of a wavelength at frequency $f_1$).

In some configurations, the height H of antenna 54 of FIGS. 4 and 5 in dimension 64 may be limited by the amount of near-field coupling between resonating element 54-1A and ground plane 54-2. For a specified antenna bandwidth and gain, it may not be possible to reduce the height H without adversely affecting performance. All other variables being equal, reducing height H will generally cause the bandwidth and gain of antenna 54 to be reduced.

Figure 7:
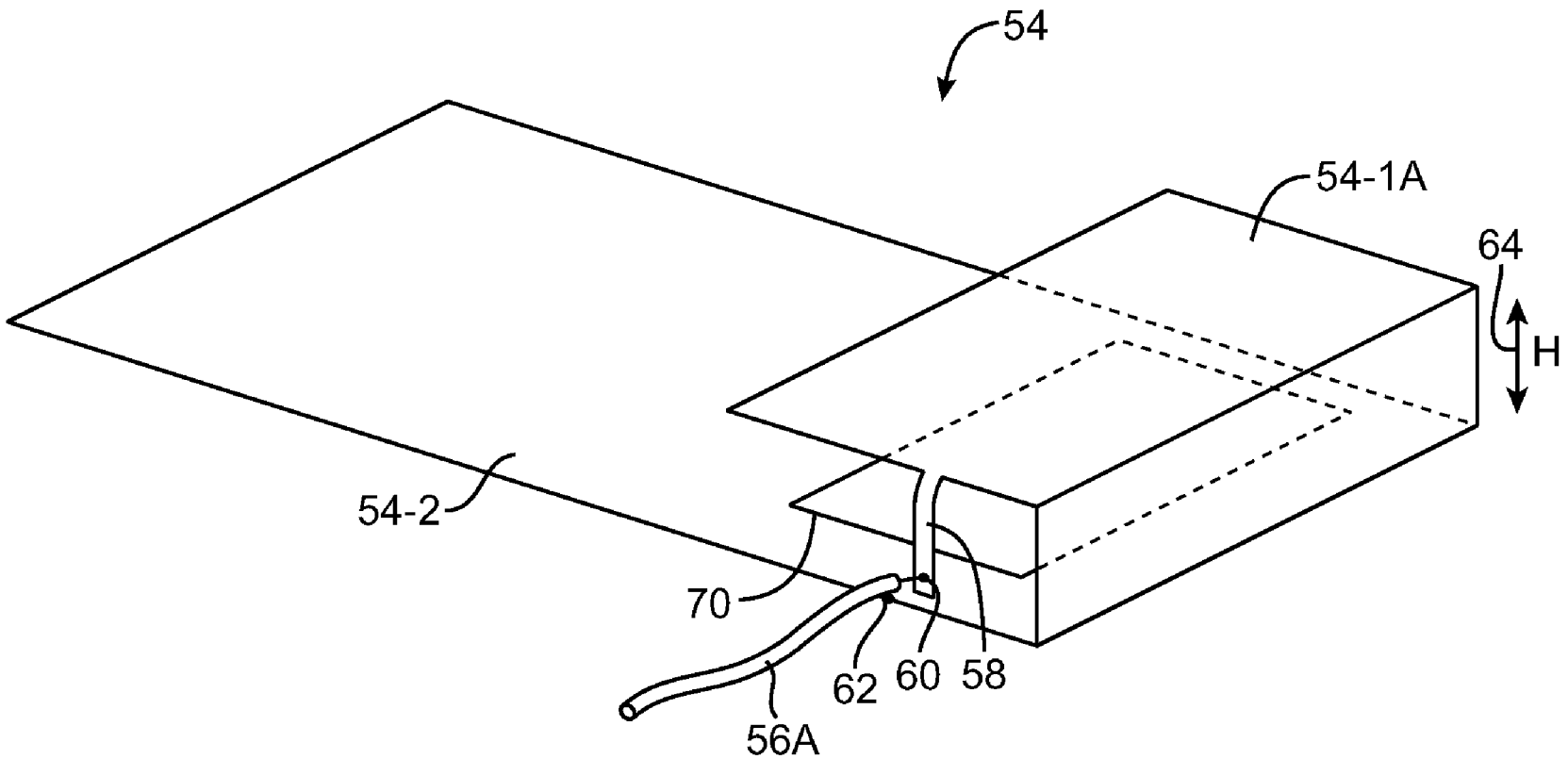
FIG. 7 is a perspective view of an illustrative planar inverted-F antenna in which a portion of the antenna's ground plane underneath the antenna's resonating element has been removed to form a slot in accordance with an embodiment of the present invention.

As shown in FIG. 7, the minimum vertical dimension of the PIFA antenna can be reduced while still satisfying minimum bandwidth and gain constraints by introducing a dielectric region 70 in the form of a slot under antenna resonating element 54-1A. The slot 70 may be filled with air, plastic, or any other suitable dielectric and represents a cut-away or removed portion of ground plane 54-2. Removed or empty region 70 may be formed from one or more holes in ground plane 54-2. These holes, which are sometimes referred to as slots or openings, may be square, circular, oval, polygonal, etc. and may extend though adjacent conductive structures in the vicinity of ground plane 54-2. With one suitable arrangement, which is shown in FIG. 7, the removed region 70 forms a rectangular slot. Slots or holes of other shapes (oval, meandering, curved sides, straight sides, etc.) may also be formed.

The slot in ground plane 54-2 may be any suitable size. For example, the slot may be slightly smaller than the outermost rectangular outline of resonating elements 54-1A and 54-2 as viewed from the top view orientation of FIG. 3B. Typical resonating element lateral dimensions are on the order of 0.5 cm to 10 cm.

The presence of slot 70 reduces near-field electromagnetic coupling between resonating element 54-1A and ground plane 54-2 and allows height H in vertical dimension 64 to be made smaller than would otherwise be possible while satisfying a given set of bandwidth and gain constraints. For example, height H may be in the range of 1-5 mm, may be in the range of 2-5 mm, may be in the range of 2-4 mm, may be in the range of 1-3 mm, may be in the range of 1-4 mm, may be in the range of 1-10 mm, may be lower than 10 mm, may be lower than 4 mm, may be lower than 3 mm, may be lower than 2 mm, or may be in any other suitable range of vertical displacements above ground plane element 54-2.

If desired, the portion of ground plane 54-2 that contains slot 70 may be used to form a slot antenna. The slot antenna structure may be used alone to form an antenna for device 10 or the slot antenna structure may be used in conjunction with one or more resonating elements to form a hybrid antenna 54. For example, one or more PIFA resonating elements may be used with the slot antenna structure to form a hybrid antenna. By operating antenna 54 so that it exhibits both PIFA operating characteristics and slot antenna operating characteristics, antenna performance can be improved.

Figure 8:
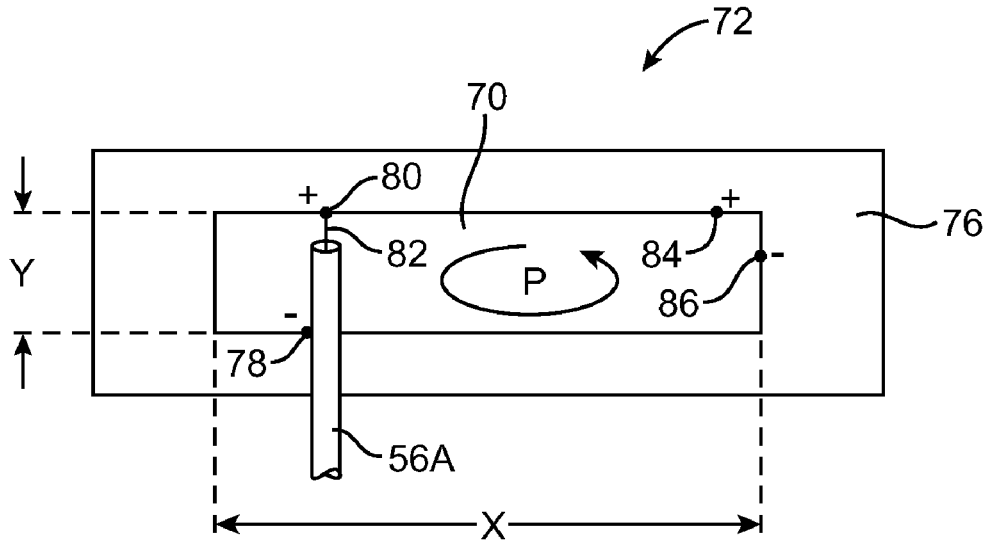
FIG. 8 is a top view of an illustrative slot antenna in accordance with an embodiment of the present invention.

A top view of an illustrative slot antenna is shown in FIG. 8. Antenna 72 of FIG. 8 is typically thin in the dimension into the page (i.e., antenna 72 is planar with its plane lying in the page). Slot 70 may be formed in the center of antenna conductor 76. A coaxial cable such as cable 56A or other transmission line path may be used to feed antenna 72. In the example of FIG. 8, antenna 72 is fed so that center conductor 82 of coaxial cable 56A is connected to signal terminal 80 (i.e., the positive or feed terminal of antenna 72) and the outer braid of coaxial cable 56A, which forms the ground conductor for cable 56A, is connected to ground terminal 78.

Figure 9:
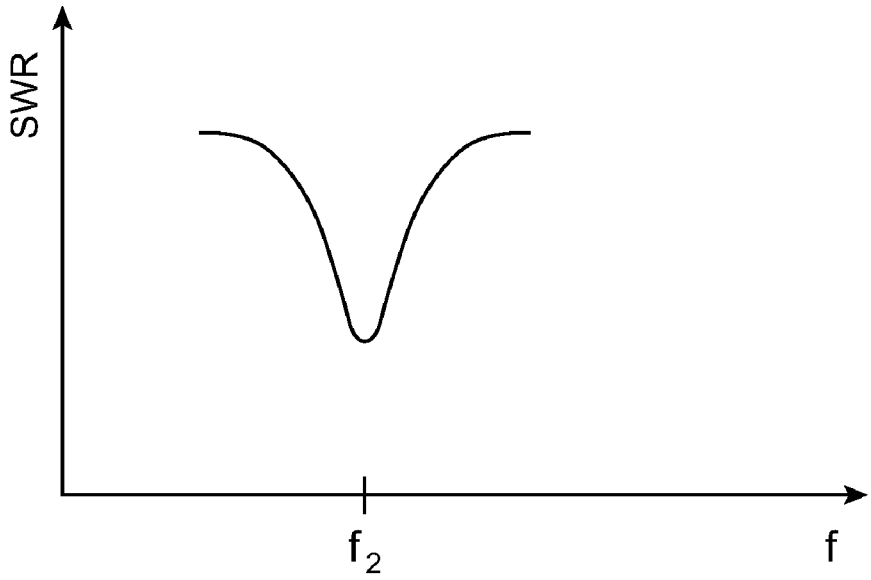
FIG. 9 is an illustrative antenna performance graph for an antenna of the type shown in FIG. 8 in which standing-wave-ratio (SWR) values are plotted as a function of operating frequency in accordance with an embodiment of the present invention.

When antenna 72 is fed using the arrangement of FIG. 8, the antenna's performance is given by the graph of FIG. 9. As shown in FIG. 9, antenna 72 operates in a frequency band that is centered about center frequency $f_2$. The center frequency $f_2$ is determined by the dimensions of slot 70. Slot 70 has an inner perimeter P that is equal to two times dimension X plus two times dimension Y (i.e., P=2X+2Y). At center frequency $f_2$, perimeter P is equal to one wavelength.

Because the center frequency $f_2$ can be tuned by proper selection of perimeter P, the slot antenna of FIG. 8 can be configured so that frequency $f_2$ of the graph in FIG. 9 coincides with frequency $f_2$ of the graph in FIG. 6. In an antenna design of this type in which slot 70 is combined with a PIFA structure, the presence of slot 70 increases the gain of the antenna at frequency $f_2$. In the vicinity of frequency $f_2$, the increase in performance from using slot 70 results in the antenna performance plot given by dotted line 79 in FIG. 6.

If desired, the value of perimeter P may be selected to resonate at a frequency that is different from frequency $f_2$ (i.e., out-of-band). In this scenario, the presence of slot 70 does not increase the performance of the antenna at resonant frequency $f_2$. Nevertheless, the removal of the conductive material from the region of slot 70 reduces near-field electromagnetic coupling between resonating elements such as resonating element 54-1A and ground plane 54-2 and allows height H in vertical dimension 64 to be made smaller than would otherwise be possible while satisfying a given set of bandwidth and gain constraints.

The position of terminals 80 and 78 may be selected for impedance matching. If desired, terminals such as terminals 84 and 86, which extend around one of the corners of slot 70 may be used to feed antenna 72. In this situation, the distance between terminals 84 and 86 may be chosen to properly adjust the impedance of antenna 72. In the illustrative arrangement of FIG. 8, terminals 84 and 86 are shown as being respectively configured as a slot antenna ground terminal and a slot antenna signal terminal, as an example. If desired, terminal 84 could be used as a ground terminal and terminal 86 could be used as a signal terminal. Slot 70 is typically air-filled, but may, in general, be filled with any suitable dielectric.

By using slot 70 in combination with a PIFA-type resonating element such as resonating element 54-1A, a hybrid PIFA/slot antenna is formed (sometimes referred to herein as a hybrid antenna). Handheld electronic device 10 may, if desired, have a PIFA/slot hybrid antenna of this type (e.g., for cellular telephone communications) and a strip antenna (e.g., for WiFi/Bluetooth communications).

Figure 10:
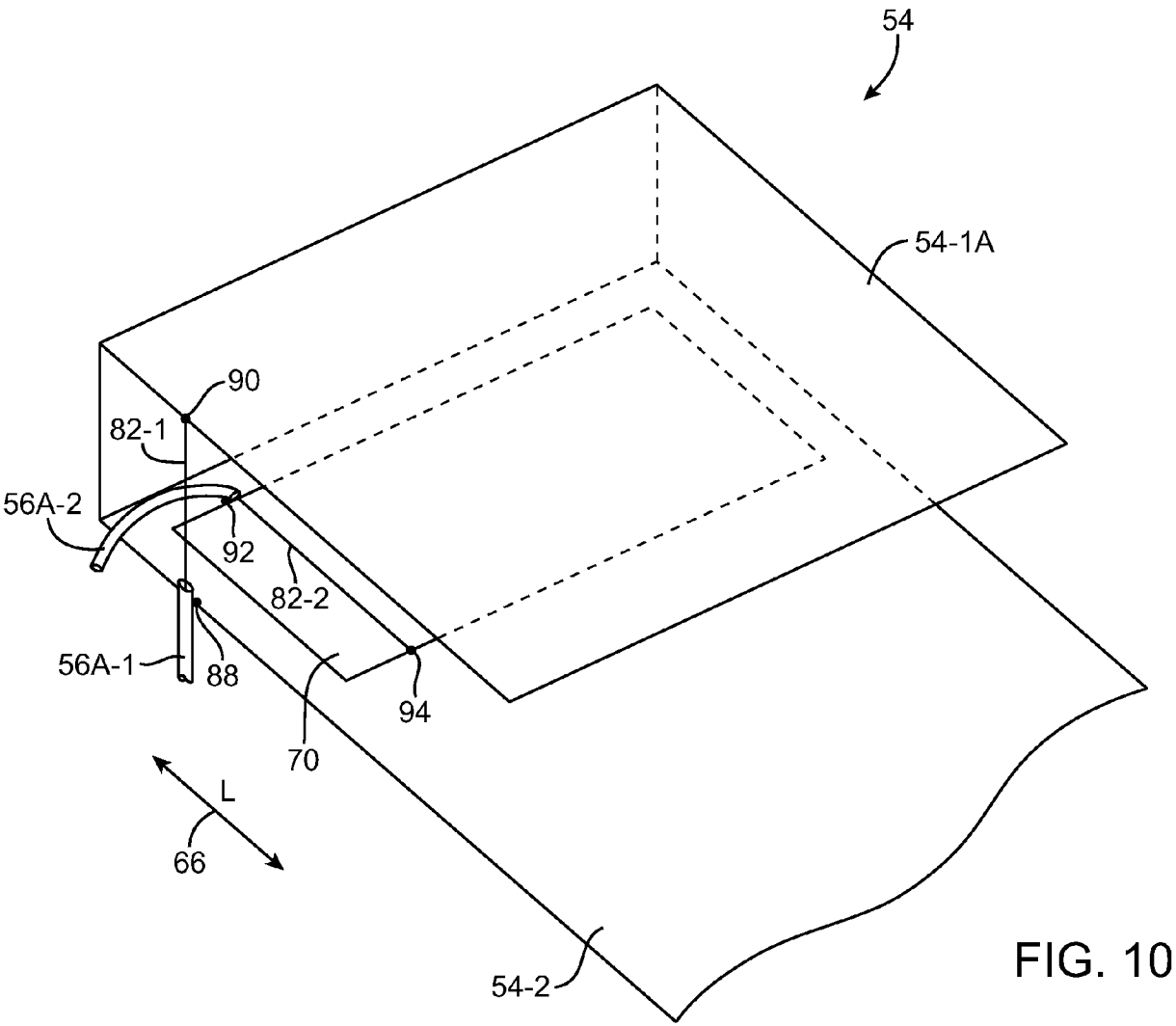
FIG. 10 is a perspective view of an illustrative hybrid PIFA/slot antenna formed by combining a planar inverted-F antenna with a slot antenna in which the antenna is being fed by two coaxial cable feeds in accordance with an embodiment of the present invention.

An illustrative configuration in which the hybrid PIFA/slot antenna formed by resonating element 54-1A, slot 70, and ground plane 54-2 is fed using two coaxial cables (or other transmission lines) is shown in FIG. 10. When the antenna is fed as shown in FIG. 10, both the PIFA and slot antenna portions of the antenna are active. As a result, antenna 54 of FIG. 10 operates in a hybrid PIFA/slot mode. Coaxial cables 56A-1 and 56A-2 have inner conductors 82-1 and 82-2, respectively. Coaxial cables 56A-1 and 56A-2 also each have a conductive outer braid ground conductor. The outer braid conductor of coaxial cable 56A-1 is electrically shorted to ground plane 54-2 at ground terminal 88. The ground portion of cable 56A-2 is shorted to ground plane 54-2 at ground terminal 92. The signal connections from coaxial cables 56A-1 and 56A-2 are made at signal terminals 90 and 94, respectively.

With the arrangement of FIG. 10, two separate sets of antenna terminals are used. Coaxial cable 56A-1 feeds the PIFA portion of the hybrid PIFA/slot antenna using ground terminal 88 and signal terminal 90 and coaxial cable 56A-2 feeds the slot antenna portion of the hybrid PIFA/slot antenna using ground terminal 92 and signal terminal 94. Each set of antenna terminals therefore operates as a separate feed for the hybrid PIFA/slot antenna. Signal terminal 90 and ground terminal 88 serve as antenna terminals for the PIFA portion of the antenna, whereas signal terminal 94 and ground terminal 92 serve as antenna feed points for the slot portion of antenna 54. These two separate antenna feeds allow the antenna to function simultaneously using both its PIFA and its slot characteristics. If desired, the orientation of the feeds can be changed. For example, coaxial cable 56A-2 may be connected to slot 70 using point 94 as a ground terminal and point 92 as a signal terminal or using ground and signal terminals located at other points along the periphery of slot 70.

When multiple transmission lines such as transmission lines 56A-1 and 56A-2 are used for the hybrid PIFA/slot antenna, each transmission line may be associated with a respective transceiver circuit (e.g., two corresponding transceiver circuits such as transceiver circuit 52A of FIGS. 3A and 3B).

In operation in handheld device 10, a hybrid PIFA/slot antenna formed from resonating element 54-1A of FIG. 3B and a corresponding slot that is located beneath element 54-1A in ground plane 54-2 can be used to cover the GSM cellular telephone bands at 850 and 900 MHz and at 1800 and 1900 MHz (or other suitable frequency bands), whereas a strip antenna (or other suitable antenna structure) can be used to cover an additional band centered at frequency $f_n$ (or another suitable frequency band or bands). By adjusting the size of the strip antenna or other antenna structure formed from resonating element 54-1B, the frequency $f_n$ may be controlled so that it coincides with any suitable frequency band of interest (e.g., 2.4 GHz for Bluetooth/WiFi, 2170 MHz for UMTS, or 1550 MHz for GPS).

Figure 11:
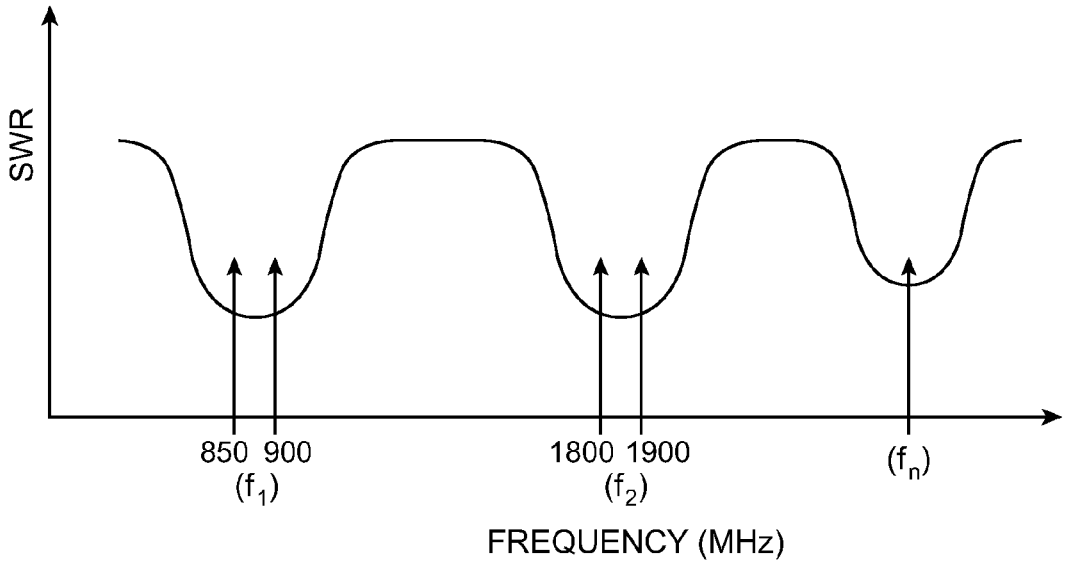
FIG. 11 is an illustrative wireless coverage graph in which antenna standing-wave-ratio (SWR) values are plotted as a function of operating frequency for a handheld device that contains a hybrid PIFA/slot antenna and a strip antenna in accordance with an embodiment of the present invention.

A graph showing the wireless performance of device 10 when using two antennas (e.g., a hybrid PIFA/slot antenna formed from resonating element 54-1A and a corresponding slot and an antenna formed from resonating element 54-2) is shown in FIG. 11. In the example of FIG. 11, the PIFA operating characteristics of the hybrid PIFA/slot antenna are used to cover the 850/900 MHz and the 1800/1900 MHz GSM cellular telephone bands, the slot antenna operating characteristics of the hybrid PIFA/slot antenna are used to provide additional gain and bandwidth in the 1800/1900 MHz range, and the antenna formed from resonating element 54-1B is used to cover the frequency band centered at $f_n$ (e.g., 2.4 GHz for Bluetooth/WiFi, 2170 MHz for UMTS, or 1550 MHz for GPS). This arrangement provides coverage for four cellular telephone bands and a data band.

Figure 12:
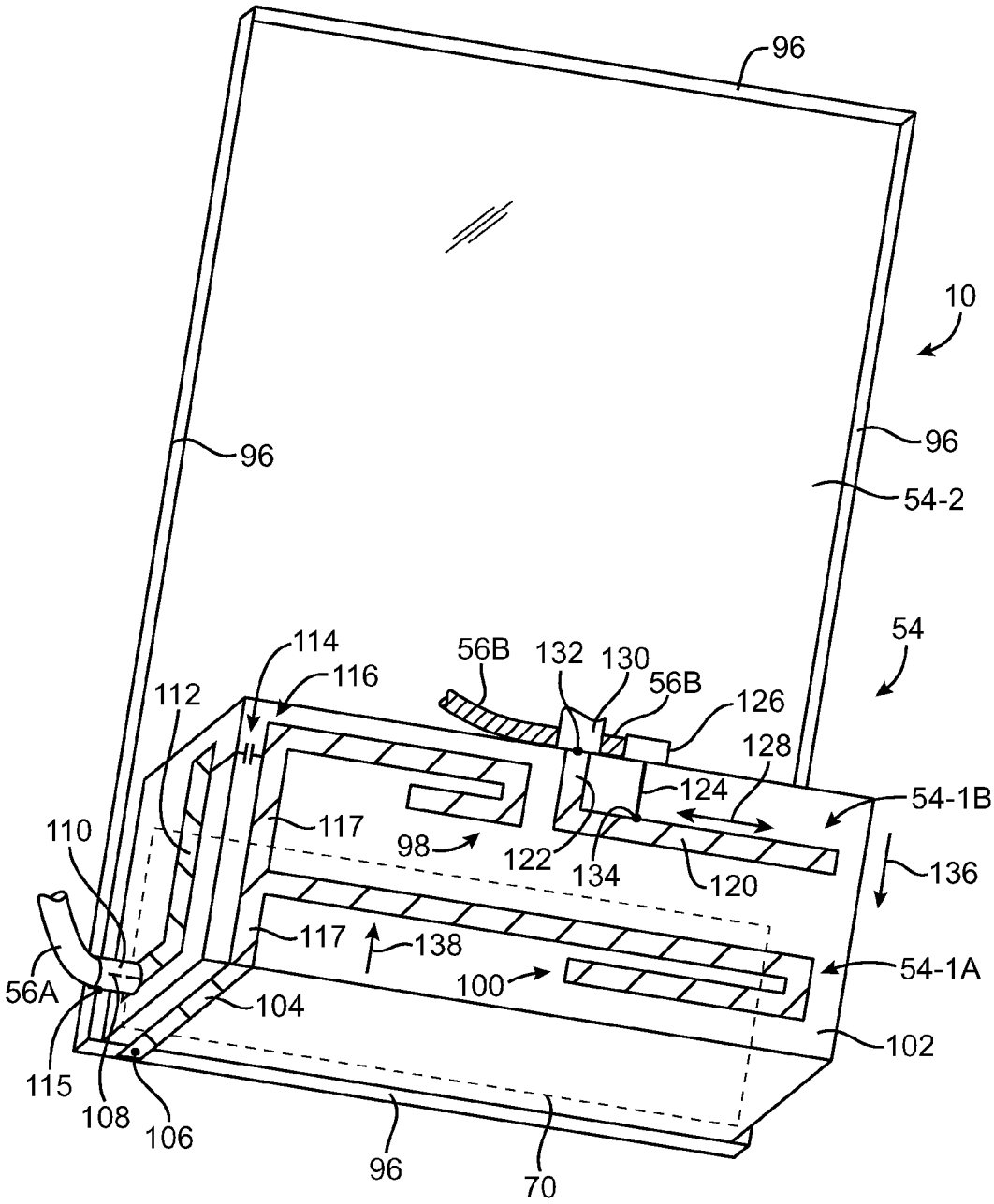
FIG. 12 is a perspective view of an illustrative handheld electronic device antenna arrangement in which a first of two handheld electronic device antennas has an associated isolation element that serves to reduce interference with from a second of the two handheld electronic device antennas in accordance with an embodiment of the present invention.

If desired, the hybrid PIFA/slot antenna formed from resonating element 54-1A and slot 70 may be fed using a single coaxial cable or other such transmission line. An illustrative configuration in which a single transmission line is used to simultaneously feed both the PIFA portion and the slot portion of the hybrid PIFA/slot antenna and in which a strip antenna formed from resonating element 54-1B is used to provide additional frequency coverage for device 10 is shown in FIG. 12. Ground plane 54-2 may be formed from metal (as an example). Edges 96 of ground plane 54-2 may be formed by bending the metal of ground plane 54-2 upward (as an example). When inserted into housing 12 (FIG. 3A), edges 96 may rest within the sidewalls of metal housing portion 12-1 and may form electrical contact with bezel 14. If desired, ground plane 54-2 may be formed using one or more metal layers in a printed circuit board, metal foil, portions of housing 12, portions of display 16, or other suitable conductive structures.

In the embodiment of FIG. 12, resonating element 54-1B has an L-shaped conductive strip formed from conductive branch 122 and conductive branch 120. Branches 120 and 122 may be formed from metal that is supported by dielectric support structure 102. With one suitable arrangement, the resonating element structures of FIG. 12 are formed as part of a patterned flex circuit that is attached to support structure 102 (e.g., by adhesive).

Coaxial cable 56B or other suitable transmission line has a ground conductor connected to ground terminal 132 and a signal conductor connected to signal terminal 124. Any suitable mechanism may be used for attaching the transmission line to the antenna. In the example of FIG. 12, the outer braid ground conductor of coaxial cable 56B is connected to ground terminal 132 using metal tab 130. Metal tab 130 may be shorted to housing portion 12-1 (e.g., using conductive adhesive). Transmission line connection structure 126 may be, for example, a mini UFL coaxial connector. The ground of connector 126 may be shorted to terminal 132 and the center conductor of connector 126 may be shorted to conductive path 124.

When feeding antenna 54-1B, terminal 132 may be considered to form the antenna's ground terminal and the center conductor of connector 126 and/or conductive path 124 may be considered to form the antenna's signal terminal. The location along dimension 128 at which conductive path 124 meets conductive strip 120 can be adjusted for impedance matching.

Planar antenna resonating element 54-1A of the illustrative hybrid PIFA/slot antenna of FIG. 12 may have an F-shaped structure with shorter arm 98 and longer arm 100. The lengths of arms 98 and 100 and the dimensions of other structures such as slot 70 and ground plane 54-2 may be adjusted to tune the frequency coverage and antenna isolation properties of device 10. For example, length L of ground plane 54-2 may be configured so that the PIFA portion of the hybrid PIFA/slot antenna formed with resonating element 54-1A resonates at the 850/900 MHz GSM bands, thereby providing coverage at frequency $f_1$ of FIG. 11. The length of arm 100 may be selected to resonate at the 1800/1900 MHz bands, thereby helping the PIFA/slot antenna to provide coverage at frequency $f_2$ of FIG. 11. The perimeter of slot 70 may be configured to resonate at the 1800/1900 MHz bands, thereby reinforcing the resonance of arm 100 and further helping the PIFA/slot antenna to provide coverage at frequency $f_2$ of FIG. 11 (i.e., by improving performance from the solid line 63 to the dotted line 79 in the vicinity of frequency $f_2$, as shown in FIG. 6). If desired, the perimeter of slot 70 may be configured to resonate away from the 1800/1900 MHz bands (i.e., out-of-band). Slot 70 may also be used without the PIFA structures of FIG. 12 (i.e., as a pure slot antenna).

In a PIFA/slot configuration, arm 98 can serve as an isolation element that reduces interference between the hybrid PIFA/slot antenna formed from resonating element 54-1A and the L-shaped strip antenna formed from resonating element 54-1B. The dimensions of arm 98 can be configured to introduce an isolation maximum at a desired frequency, which is not present without the arm. It is believed that configuring the dimensions of arm 98 allows manipulation of the currents induced on the ground plane 54-2 from resonating element 54-1A. This manipulation can minimize induced currents around the signal and ground areas of resonating element 54-1B. Minimizing these currents in turn may reduce the signal coupling between the two antenna feeds. With this arrangement, arm 98 can be configured to resonate at a frequency that minimizes currents induced by arm 100 at the feed of the antenna formed from resonating element 54-1B (i.e., in the vicinity of paths 122 and 124).

Additionally, arm 98 can act as a radiating arm for element 54-1A. Its resonance can add to the bandwidth of element 54-1A and can improve in-band efficiency, even though its resonance may be different than that defined by slot 70 and arm 100. Typically an increase in bandwidth of radiating element 51-1A that reduces its frequency separation from element 51-1B would be detrimental to isolation. However, extra isolation afforded by arm 98 removes this negative effect and, moreover, provides significant improvement with respect to the isolation between elements 54-1A and 54-1B without arm 98.

As shown in FIG. 12, arms 98 and 100 of resonating element 54-1A and resonating element 54-1B may be mounted on support structure 102 (sometimes referred to as an antenna cap). Support structure 102 may be formed from plastic (e.g., ABS plastic) or other suitable dielectric. The surfaces of structure 102 may be flat or curved. The resonating elements 54-1A and 54-1B may be formed directly on support structure 102 or may be formed on a separate structure such as a flex circuit substrate that is attached to support structure 102 (as examples).

Resonating elements 54-1A and 54-B may be formed by any suitable antenna fabrication technique such as metal stamping, cutting, etching, or milling of conductive tape or other flexible structures, etching metal that has been sputter-deposited on plastic or other suitable substrates, printing from a conducive slurry (e.g., by screen printing techniques), patterning metal such as copper that makes up part of a flex circuit substrate that is attached to support 102 by adhesive, screws, or other suitable fastening mechanisms, etc.

A conductive path such as conductive strip 104 may be used to electrically connect the resonating element 54-1A to ground plane 54-2 at terminal 106. A screw or other fastener at terminal 106 may be used to electrically and mechanically connect strip 104 (and therefore resonating element 54-1A) to edge 96 of ground plane 54-2 (bezel 14). Conductive structures such as strip 104 and other such structures in the antennas may also be electrically connected to each other using conductive adhesive.

A coaxial cable such as cable 56A or other transmission line may be connected to the hybrid PIFA/slot antenna to transmit and receive radio-frequency signals. The coaxial cable or other transmission line may be connected to the structures of the hybrid PIFA/slot antenna using any suitable electrical and mechanical attachment mechanism. As shown in the illustrative arrangement of FIG. 12, mini UFL coaxial connector 110 may be used to connect coaxial cable 56A or other transmission lines to antenna conductor 112. A center conductor of the coaxial cable or other transmission line is connected to center connector 108 of connector 110. An outer braid ground conductor of the coaxial cable is electrically connected to ground plane 54-2 via connector 110 at point 115 (and, if desired, may be shorted to ground plane 54-2 at other attachment points upstream of connector 110). A bracket may be used to ground connector 110 to bezel 14 at this portion of the ground plane.

Conductor 108 may be electrically connected to antenna conductor 112. Conductor 112 may be formed from a conductive element such as a strip of metal (e.g., a copper trace) formed on a sidewall surface of support structure 102 (e.g., as part of the flex circuit that contains resonating elements 54-1A and 54-1B.). Conductor 112 may be directly electrically connected to resonating element 54-1A (e.g., at portion 116) or may be electrically connected to resonating element 54-1A through tuning capacitor 114 or other suitable electrical components. The size of tuning capacitor 114 can be selected to tune antenna 54 and ensure that antenna 54 covers the frequency bands of interest for device 10.

Slot 70 may lie beneath resonating element 54-1A of FIG. 12. The signal from center conductor 108 may be routed to point 106 on ground plane 54-2 in the vicinity of slot 70 using a conductive path formed from antenna conductor 112, optional capacitor 114 or other such tuning components, antenna conductor 117, and antenna conductor 104.

The configuration of FIG. 12 allows a single coaxial cable or other transmission line path to simultaneously feed both the PIFA portion and the slot portion of the hybrid PIFA/slot antenna.

Grounding point 115 functions as the ground terminal for the slot antenna portion of the hybrid PIFA/slot antenna that is formed by slot 70 in ground plane 54-2. Point 106 serves as the signal terminal for the slot antenna portion of the hybrid PIFA/slot antenna. Signals are fed to point 106 via the path formed by conductive path 112, tuning element 114, path 117, and path 104.

For the PIFA portion of the hybrid PIFA/slot antenna, point 115 serves as antenna ground. Center conductor 108 and its attachment point to conductor 112 serve as the signal terminal for the PIFA. Conductor 112 serves as a feed conductor and feeds signals from signal terminal 108 to PIFA resonating element 54-1A.

In operation, both the PIFA portion and slot antenna portion of the hybrid PIFA/slot antenna contribute to the performance of the hybrid PIFA/slot antenna.

The PIFA functions of the hybrid PIFA/slot antenna are obtained by using point 115 as the PIFA ground terminal (as with terminal 62 of FIG. 7), using point 108 at which the coaxial center conductor connects to conductive structure 112 as the PIFA signal terminal (as with terminal 60 of FIG. 7), and using conductive structure 112 as the PIFA feed conductor (as with feed conductor 58 of FIG. 7). During operation, antenna conductor 112 serves to route radio-frequency signals from terminal 108 to resonating element 54-1A in the same way that conductor 58 routes radio-frequency signal from terminal 60 to resonating element 54-1A in FIGS. 4 and 5, whereas conductive line 104 serves to terminate the resonating element 54-1A to ground plane 54-2, as with grounding portion 61 of FIGS. 4 and 5.

The slot antenna functions of the hybrid PIFA/slot antenna are obtained by using grounding point 115 as the slot antenna ground terminal (as with terminal 86 of FIG. 8), using the conductive path formed of antenna conductor 112, tuning element 114, antenna conductor 117, and antenna conductor 104 as conductor 82 of FIG. 8 or conductor 82-2 of FIG. 10, and by using terminal 106 as the slot antenna signal terminal (as with terminal 84 of FIG. 8).

The illustrative configuration of FIG. 10 demonstrates how slot antenna ground terminal 92 and PIFA antenna ground terminal 88 may be formed at separate locations on ground plane 54-2. In the configuration of FIG. 12, a single coaxial cable may be used to feed both the PIFA portion of the antenna and the slot portion of the hybrid PIFA/slot antenna. This is because terminal 115 serves as both a PIFA ground terminal for the PIFA portion of the hybrid antenna and a slot antenna ground terminal for the slot antenna portion of the hybrid antenna. Because the ground terminals of the PIFA and slot antenna portions of the hybrid antenna are provided by a common ground terminal structure and because conductive paths 112, 117, and 104 serve to distribute radio-frequency signals to and from the resonating element 54-1A and ground plane 54-2 as needed for PIFA and slot antenna operations, a single transmission line (e.g., coaxial conductor 56A) may be used to send and receive radio-frequency signals that are transmitted and received using both the PIFA and slot portions of the hybrid PIFA/slot antenna.

If desired, other antenna configurations may be used that support hybrid PIFA/slot operation. For example, the radio-frequency tuning capabilities of tuning capacitor 114 may be provided by a network of other suitable tuning components, such as one or more inductors, one or more resistors, direct shorting metal strip(s), capacitors, or combinations of such components. One or more tuning networks may also be connected to the hybrid antenna at different locations in the antenna structure. These configurations may be used with single-feed and multiple-feed transmission line arrangements.

Moreover, the location of the signal terminal and ground terminal in the hybrid PIFA/slot antenna may be different from that shown in FIG. 12. For example, terminals 115/108 and terminal 106 can be moved relative to the locations shown in FIG. 12, provided that the connecting conductors 112, 117, and 104 are suitably modified.

The PIFA portion of the hybrid PIFA/slot antenna can be provided using a substantially F-shaped conductive element having one or more arms such as arms 98 and 100 of FIG. 12 or using other arrangements (e.g., arms that are straight, serpentine, curved, have 90° bends, have 180° bends, etc.). The strip antenna formed with resonating element 54-1B can also be formed from conductors of other shapes. Use of different shapes for the arms or other portions of resonating elements 54-1A and 54-1B helps antenna designers to tailor the frequency response of antenna 54 to its desired frequencies of operation and maximize isolation. The sizes of the structures in resonating elements 54-1A and 54-1B can be adjusted as needed (e.g., to increase or decrease gain and/or bandwidth for a particular operating band, to improve isolation at a particular frequency, etc.).

Figure 13:
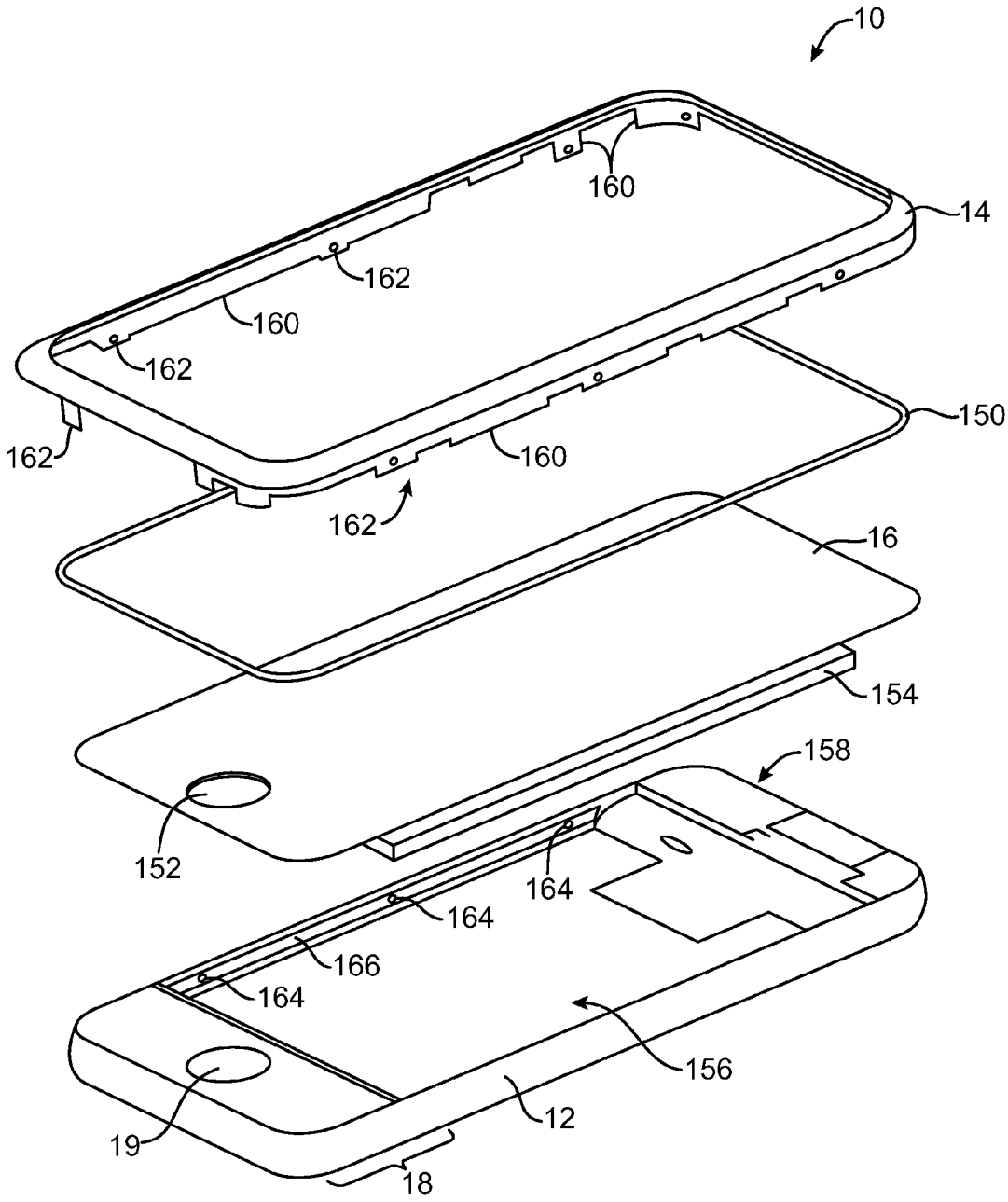
FIG. 13 is an exploded perspective view of an illustrative handheld electronic device with a conductive bezel in accordance with an embodiment of the present invention.

An exploded perspective view of an illustrative handheld electronic device 10 in accordance with an embodiment of the present invention is shown in FIG. 13. As shown in FIG. 13, handheld electronic device 10 may have a conductive bezel such as conductive bezel 14 for securing display 16 or other such planar components to lower housing portion 12. A gasket such as gasket 150 may be interposed between bezel 14 and the exposed surface of display 16. Gasket 150 may be formed of silicone or other soft plastic (as an example). Gasket 150 may have any suitable cross-sectional shape. For example, gasket 150 may have a circular cross section (i.e., gasket 150 may be an o-ring), gasket 150 may have a rectangular cross-section, etc. Display 16 may have one or more holes or cut-away portions. For example, display 16 may have hole 152 to accommodate button 19 on lower housing portion 12.

If desired, display 16 may be touch sensitive. In touch sensitive arrangements, display 16 may have a touch sensor such as touch sensor 154 that is mounted below the active portion of display screen 16. Lower housing 12 may have a recess 156 that accommodates the display and touch sensor components associated with display 16. Antenna structures may be housed behind a plastic end cap in region 18. Additional components (e.g., a speaker, etc.) may be housed in region 158 at the opposite end of device 10.

Bezel 14 may be secured to housing 12 using any suitable technique (e.g., with fasteners, with snaps, with adhesive, using welding techniques, using a combination of these approaches, etc.). As shown in FIG. 13, bezel 14 may have portions 160 that extend downwards. Portions 160 may take the form of prongs, rails, and other protruding features. Portions 160 may be configured so that the outer perimeter of portions 160 mates with the inner perimeter of recess 156.

Portions 160 may have screw holes 162 that mate with corresponding screw holes 164 on lower housing portion 12. Screws or other fasteners may be used to attach bezel 14 to lower housing portion 156. The screws and other conductive attachment structures (e.g., welds, wires, etc.) may be used to electrically connect bezel 14 to ground elements within device 10. For ease of assembly, portions of lower housing 12 (i.e., the portions of lower housing 12 that include screw holes, such as portion 166) may have tabs, snaps, or other attachment structures. During assembly, portion 166 may be attached to bezel 14 using screws. After portion 166 and bezel 14 have been attached to each other, the attachment structures on portion 166 may be inserted into mating structures on lower housing portion 12 to attach portion 166, bezel 14, gasket 150, and display 16 to lower housing portion 12.

Figure 14:
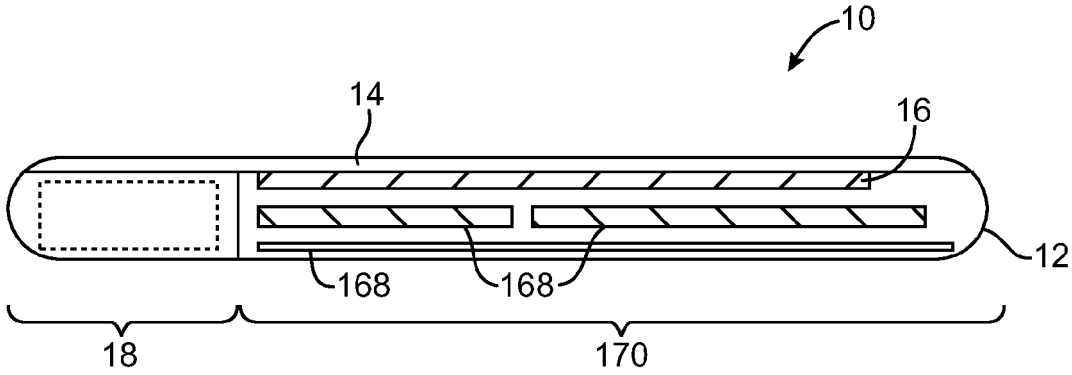
FIG. 14 is a cross-sectional side view of an illustrative handheld electronic device with a conductive bezel in accordance with an embodiment of the present invention.

When arrangements of the type shown in FIG. 13 are used for handheld electronic device 10, the antenna resonating elements of device 10 may be housed in region 18. A cross-sectional view of an illustrative handheld electronic device 10 in which the location of region 18 is shown relative to the grounded components of device 10 and bezel 14 is presented in FIG. 14. As shown in FIG. 14, bezel 14 may be used to mount display 16 to housing 12. Electrical components 168 such as printed circuit boards, flex circuits, integrated circuits, batteries, and other devices may be mounted within portion 170 of device 10. The conductive structures within portion 170 can be electrically connected to one another so that they serve as ground for the antenna(s) in device 10. Bezel 14 can also be electrically connected to portion 170 (e.g., through welds, metal screws, metal clips, press-fit contact between adjacent metal parts, wires, etc.).

Figure 15:
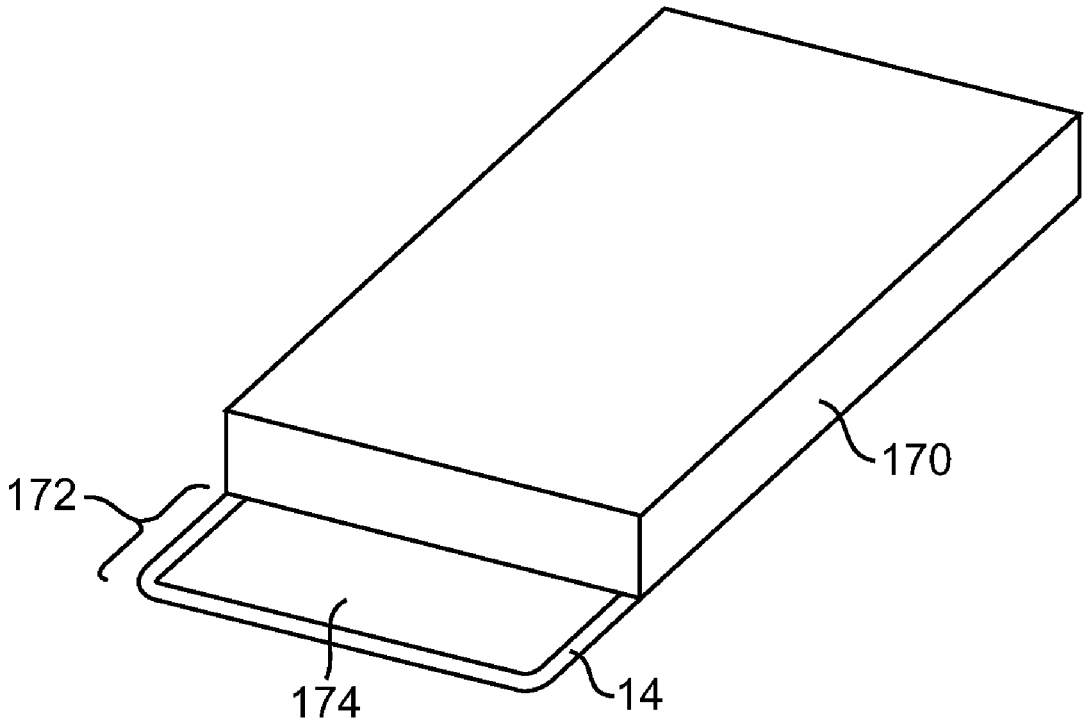
FIG. 15 is a somewhat simplified interior perspective view of an illustrative handheld electronic device with a conductive bezel in accordance with an embodiment of the present invention.

As a result of these electrical connections, bezel 14 and conductive portion 170 of device 10 may be configured as shown in FIG. 15. As shown in FIG. 15, conductive portion 170 may serve as the antenna ground plane for device 10. Portion 172 of bezel 14 may extend outwards from grounded portion 170 so as to form opening 174. Opening 174 can accommodate one or more antennas that have ground plane openings, such as slot 70.

With one suitable configuration, opening 174 may be sized to directly form a ground plane slot or hole (e.g., slot 70 of FIG. 12). In this type of arrangement, the dimensions of opening 174 coincide with the dimensions of the opening of slot 70. If desired, opening 174 may be large enough to accommodate a somewhat smaller slot opening within its borders. In this type of arrangement, the opening of slot 70 may be formed as an opening in a circuit board ground plane or an opening within other conductive structures. The slot may therefore form an opening that has an area that is smaller than opening 174, so that slot 70 is contained entirely within opening 174. With another possible arrangement, slot 70 overlaps with opening 174. In this type of configuration, the effective area of the opening of slot 70 may be reduced in size, so that the resulting antenna opening is confined to the area of overlap between the slot and opening 174.

Figure 16:
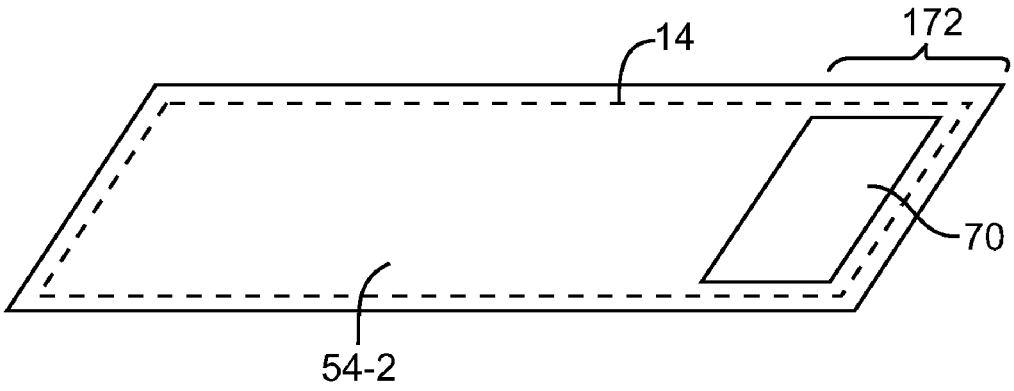
FIG. 16 is a perspective view of an illustrative slot antenna that may be used in a handheld electronic device containing a conductive bezel in accordance with an embodiment of the present invention.

FIG. 16 shows a possible location for bezel 14 relative to a slot 70 in antenna ground plane 54-2. The location of bezel 14 in FIG. 16 is indicated by a dashed line. As indicated by the example of FIG. 16, slot 70 may be used to form a slot antenna for the handheld electronic device. The slot antenna may operate as described in connection with FIG. 8. The location of conductive bezel 14 that is indicated by the dashed line in FIG. 16 accommodates the slot antenna, because slot 70 can be formed within the opening 174 (FIG. 15) that is formed by bezel 14 in region 172.

Figure 17:
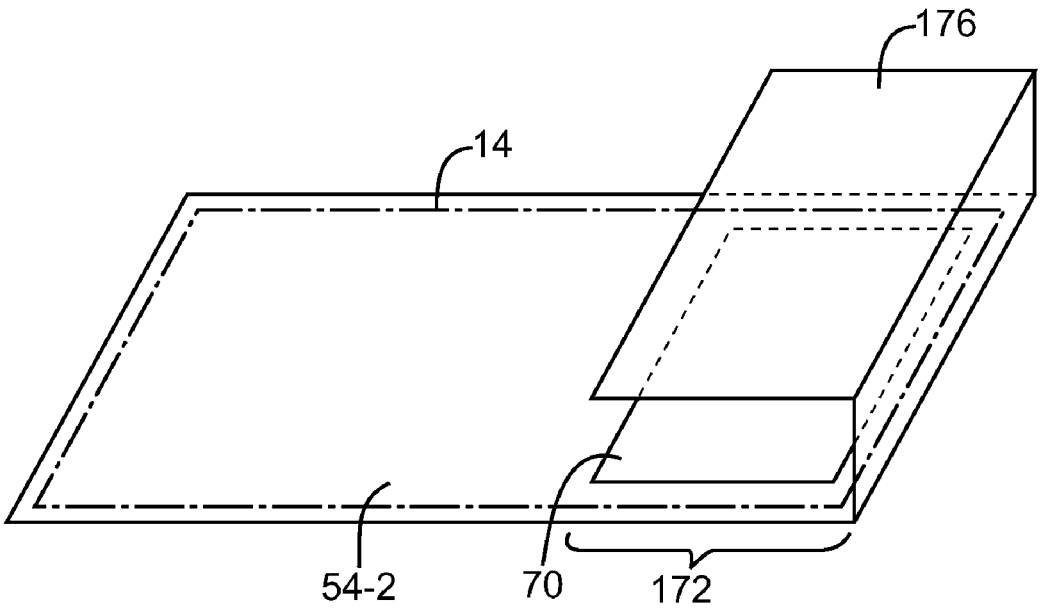
FIG. 17 is a perspective view of an illustrative hybrid antenna that may be used in a handheld electronic device containing a conductive bezel in accordance with an embodiment of the present invention.

As shown in FIG. 17, the handheld electronic device 10 may have a hybrid antenna. The hybrid antenna may be formed from a slot antenna and additional resonating structures, such as PIFA resonating structures. In the example of FIG. 17, slot 70 is used to form a slot portion of the hybrid antenna and PIFA resonating element 176 forms a PIFA portion of the hybrid antenna. A possible location for bezel 14 that accommodates the hybrid antenna is shown by dashed-and-dotted line 14. The slot in the hybrid antenna of FIG. 17 may be configured for in-band resonance (e.g., as described in connection with slot 70 of FIG. 12) or may be configured for out-of-band resonance (in which case the slot resonates at a portion of the frequency spectrum that is not being used for antenna transmission and reception). Moreover, although PIFA portion 176 is shown as including a solid resonating element located above slot 70, there may be one or more resonating elements located above slot 70 and these resonating elements may have any desired shapes (e.g., straight or meandering arms, solid rectangles, rectangles with gaps, etc.).

Figure 18:
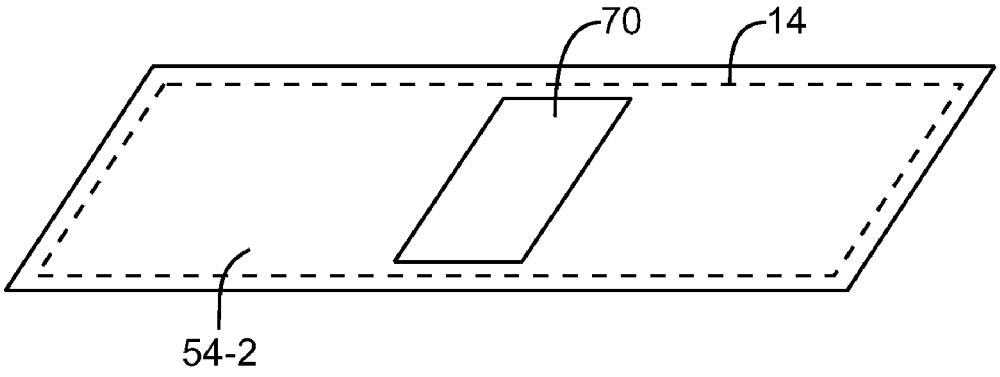
FIG. 18 is a perspective view of an illustrative handheld electronic device slot antenna in which the slot is located in an interior portion of a ground plane and in which a conductive bezel surrounds the periphery of the ground plane in accordance with an embodiment of the present invention.

Bezel 14 may accommodate slots in various positions along the surface of handheld electronic device 10. For example, slot 70 may be located in the center of ground plane 54-2, as shown in FIG. 18. In the example of FIG. 18, the bezel of the handheld electronic device may be located where indicated by dashed line 14. In this location, bezel 14 may accommodate a centrally located slot, such as slot 70.

Figure 19:
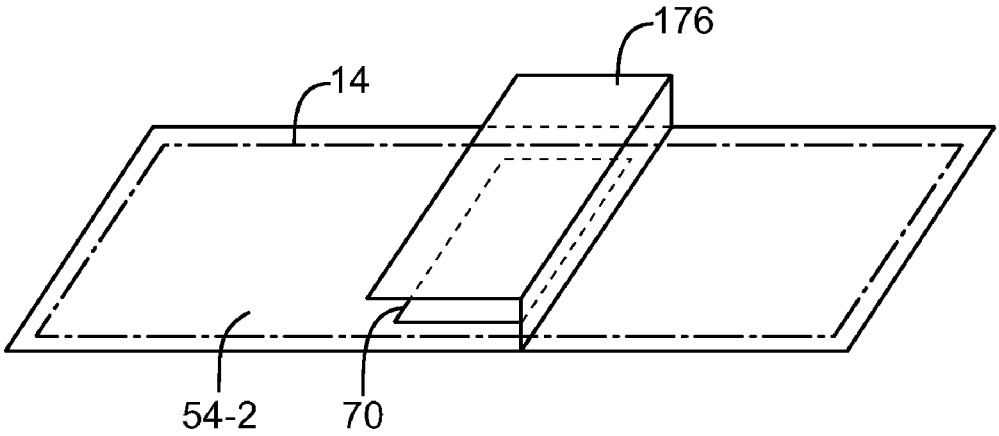
FIG. 19 is a perspective view of an illustrative handheld electronic device hybrid antenna in which a slot is located in an interior portion of a ground plane and in which a conductive bezel surrounds the periphery of the ground plane in accordance with an embodiment of the present invention.

A central location may also be used in hybrid antenna arrangements. As shown in FIG. 19, for example, slot 70 and resonating element 176 may be formed at a central location within ground plane 54-2. In this type of illustrative configuration, the bezel of the handheld electronic device may be located where indicated by dashed-and-dotted line 14. Because bezel 14 is located around the periphery of ground plane 54-2, bezel 14 may extend around slot 70 to accommodate the centrally located antenna.

Figure 20:
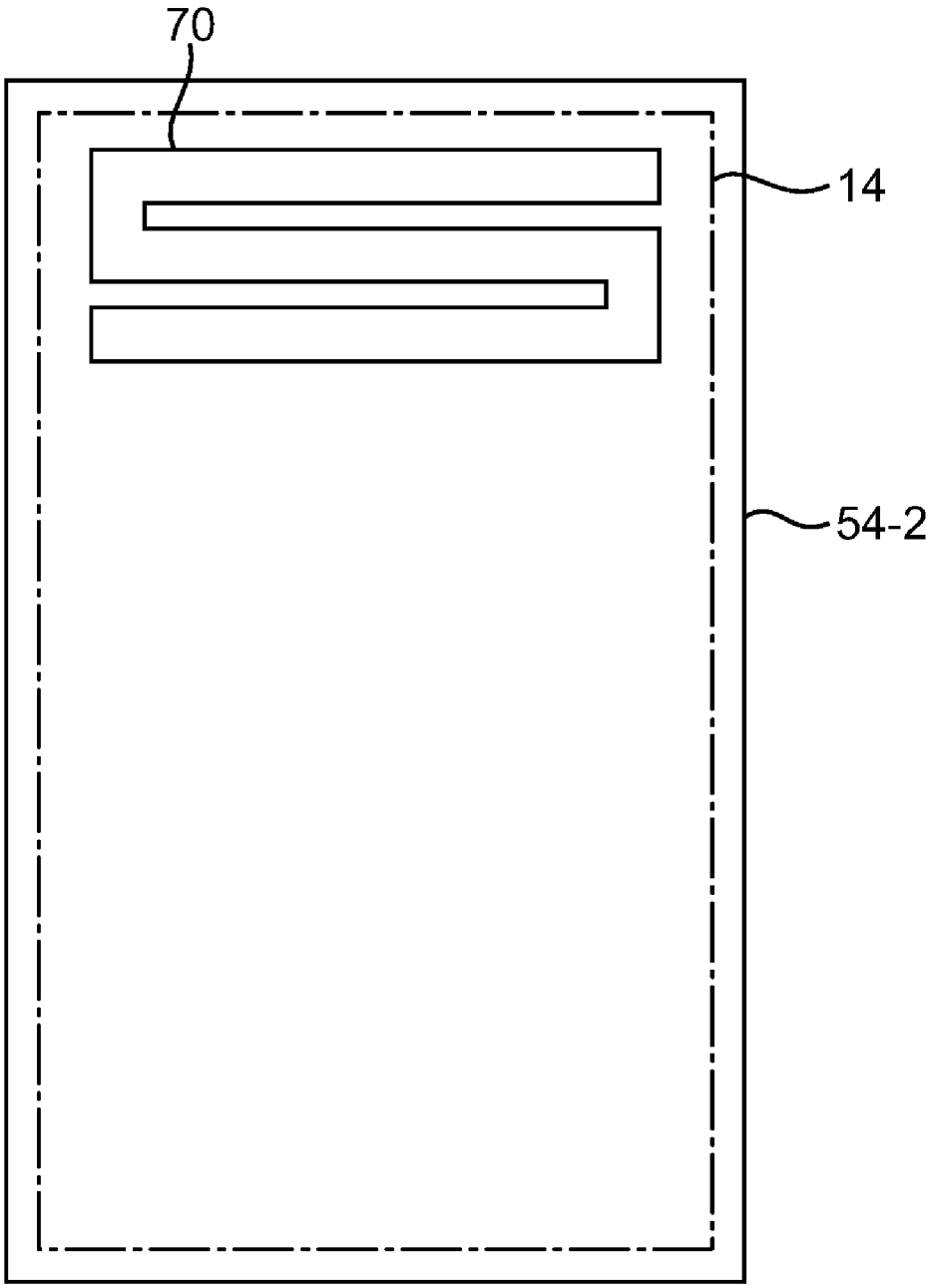
FIG. 20 is a top view of an illustrative handheld electronic device slot antenna in which the slot follows a meandering path and in which a conductive bezel surrounds the periphery of the ground plane in accordance with an embodiment of the present invention.

Peripherally located bezels are compatible with slots of various shapes. The example of FIG. 20 shows how slot 70 may follow a meandering path. This type of arrangement may be used in applications in which a relatively larger inner perimeter P is desired for a slot antenna or for the slot portion of a hybrid antenna. The meandering path increases the inner perimeter of slot 70 while minimizing increases in slot area. Bezel 14 may be located as shown by dotted-and-dashed lines 14 to accommodate slot 70 and, if desired, optional resonating elements may be provided above slot 70 for forming one or more hybrid antennas.

Figure 21:
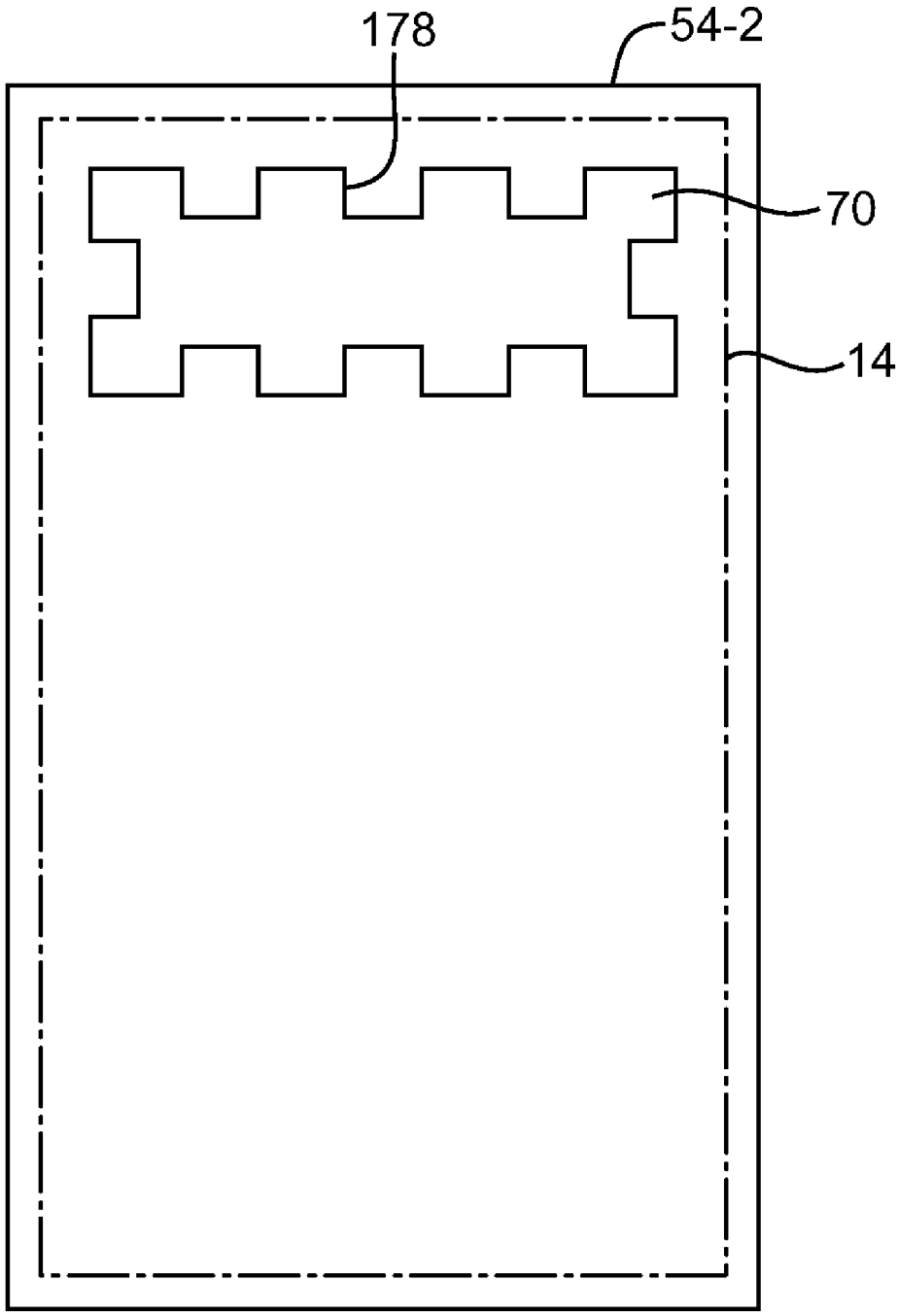
FIG. 21 is a top view of an illustrative handheld electronic device slot antenna in which the slot has a meandering border and in which a conductive bezel surrounds the periphery of the ground plane in accordance with an embodiment of the present invention.

FIG. 21 shows an another illustrative configuration. In the arrangement shown in FIG. 21, slot 70 has a meandering perimeter 178. The length of perimeter 178 is longer than the length of the perimeter of a rectangular slot with a comparable area. The use of a meandering perimeter may therefore be advantageous in which a particular perimeter P is desired to tune the antenna's operating frequency while minimizing slot area. Slots of the type shown in FIG. 21 may be used in slot antennas or in hybrid antennas (e.g., hybrid PIFA/slot antennas with in-band or out-of-band slots).

If desired, the perimeter of slot 70 may be adjusted using a radio-frequency switch. Real-time perimeter length adjustments of this type may be used to adjust a slot in a slot antenna or a hybrid antenna. By adjusting the perimeter of the slot, the frequency at which the slot resonates is adjusted proportionally.

Figure 22:
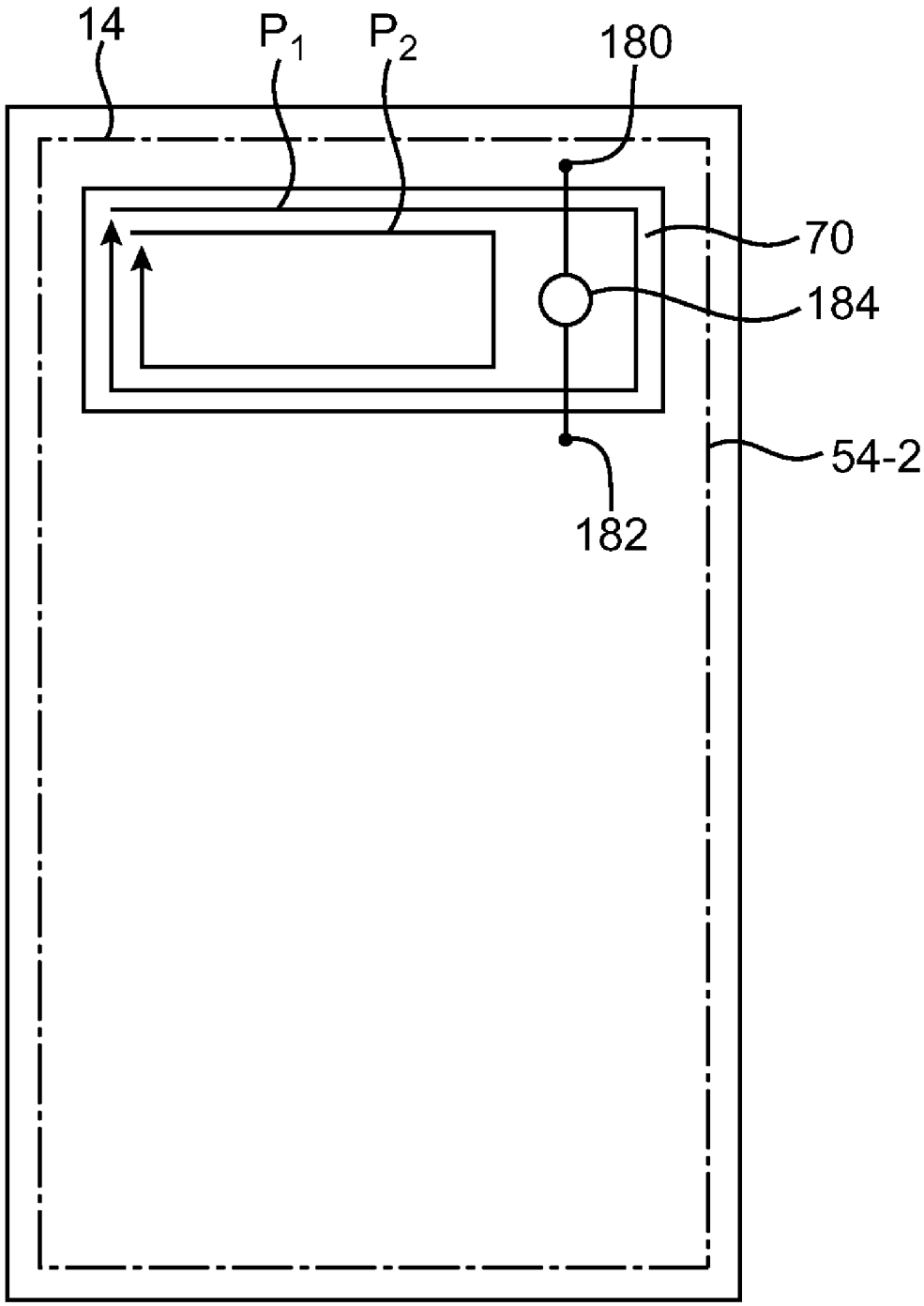
FIG. 22 is a top view of an illustrative handheld electronic device slot antenna structure in which the slot is bridged by a switch that allows the slot to be selectively shorted and thereby tuned in accordance with an embodiment of the present invention.

An illustrative embodiment of a slot with an adjustable perimeter is shown in FIG. 22. Bezel 14 may be located along the path defined by dashed-and-dotted line 14 to accommodate slot 70. Although shown as being rectangular in shape in the example of FIG. 22, slot 70 may have any suitable shape (e.g., a meandering perimeter and/or meandering path may be used).

Figure 23:
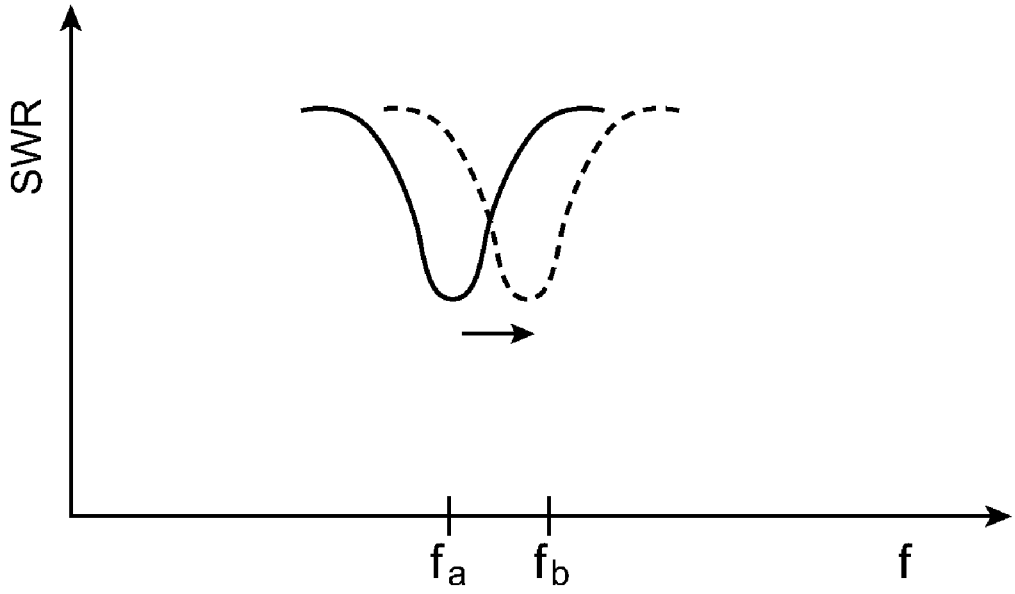
FIG. 23 is an antenna performance graph showing how the resonance peak of a tunable antenna of the type shown in FIG. 22 may be adjusted by selectively bridging a portion of the slot in accordance with an embodiment of the present invention.

As shown in FIG. 22, slot 70 may be bridged by switch 184. Switch 184 may be formed from a p-i-n diode or other suitable controllable high-frequency electronic components. The state of switch 70 may be controlled by control signals provided by control circuitry associated with the transceivers of handheld electronic device 10. When switch 184 is open, slot 70 has perimeter $P_1$. When switch 184 is closed, point 180 is shorted to point 182 through switch 184. This effectively reduces the perimeter of slot 70 to $P_2$. The perimeter length is equal to about one wavelength at the peak resonant frequency of the slot. Because $P_2$ is less than $P_1$, the resonant frequency of the slot increases when switch 184 is closed. As an example, the resonant frequency of slot 70 (and the associated antenna or antennas of device 10) may change from $f_a$ to $f_b$ when switch 184 is moved from the open to closed position, as shown in FIG. 23. When switch 184 is open, the perimeter of slot 70 is $P_1$ and the resonant frequency peak is $f_a$. When switch 184 is closed, the perimeter of slot 70 is reduced to $P_2$, so the resonant frequency peak associated with slot 70 increases to $f_b$. The tuning capability of slot 70 may be used to tune the antenna(s) of device 10 (e.g., to tune the antennas between different communications bands of interest). Slot tuning arrangements of this type may be used to tune slot antennas and hybrid antennas (as examples).

The foregoing is merely illustrative of the principles of this invention and various modifications can be made by those skilled in the art without departing from the scope and spirit of the invention.

What is claimed is:

1. A handheld electronic device, comprising:

a housing having a planar surface with a periphery;

a ground plane in the housing; and a conductive bezel that surrounds the periphery of the planar surface of the housing, wherein the conductive bezel is electrically connected to the ground plane, wherein a slot is formed between portions of the ground plane and the conductive bezel, and wherein an antenna is formed from the slot.

2. The handheld electronic device defined in claim 1 wherein the bezel comprises a stainless steel bezel.

3. The handheld electronic device defined in claim 1 wherein the slot comprises a substantially rectangular slot and wherein the antenna comprises a hybrid antenna that has at least one resonating element located above the slot.

4. The handheld electronic device defined in claim 1 further comprising at least one antenna resonating element located above the slot, wherein the antenna comprises a hybrid antenna formed from the ground plane, the slot, and the resonating element.

5. The handheld electronic device defined in claim 1 wherein the handheld electronic device further comprises at least two antenna resonating elements located above the slot.

6. The handheld electronic device defined in claim 1 further comprising a switch that bridges the slot, wherein the switch has an open position in which the slot has a first perimeter and the antenna resonates at a first frequency peak and a closed position in which the slot has a second perimeter and the antenna resonates at a second frequency peak that is higher in frequency than the first frequency peak.

7. The handheld electronic device defined in claim 1 further comprising a planar display that is mounted to the housing with the bezel.

8. The handheld electronic device defined in claim 1 further comprising:

a display that is mounted to the housing with the bezel, wherein the display has a planar surface;

a gasket interposed between the display and the bezel; and at least two antenna resonating elements located above the slot.

9. The handheld electronic device defined in claim 1 wherein the housing has lateral dimensions and wherein the ground plane has lateral dimension substantially equal to the lateral dimensions of the housing, the handheld device further comprising:

a first resonating element located above the slot, wherein the ground plane and the first resonating element form a first antenna; and a second resonating element located above the slot, wherein the ground plane and the second resonating element form a second antenna.

10. The handheld electronic device defined in claim 9 wherein the first resonating element comprises an isolation element that resonates at a common frequency with the second antenna and reduces interference between the second antenna and the first antenna during simultaneous operation of the first and second antennas.

11. The handheld electronic device defined in claim 9 wherein the second resonating element comprises a conductive strip that resonates in a 2.4 GHz communications band.

12. The handheld electronic device defined in claim 9 further comprising a first transceiver circuit and a second transceiver circuit, wherein the first antenna and the first transceiver circuit are configured to operate in a first communications frequency range that includes at least 850 MHz and 900 MHz cellular telephone bands and a second communications frequency range that includes at least 1800 MHz and 1900 MHz cellular telephone bands, wherein the second antenna resonating element comprises a conductive strip that resonates in a 2.4 GHz communications band, and wherein the first resonating element comprises an isolation element that resonates at a common frequency with the second antenna and reduces interference between the second antenna and the first antenna during simultaneous operation of the first and second antennas in the 2.4 GHz communications band.

13. The handheld electronic device defined in claim 9 further comprising a first transceiver circuit and a second transceiver circuit, wherein the first antenna and the first transceiver circuit are configured to operate in a first communications frequency range that includes at least 850 MHz and 900 MHz cellular telephone bands and a second communications frequency range that includes at least 1800 MHz and 1900 MHz cellular telephone bands and wherein the second antenna resonating element comprises a conductive structure that resonates in a 2.4 GHz communications band.

14. The handheld electronic device defined in claim 9 wherein the slot comprises a substantially rectangular slot and wherein the bezel comprises a metal bezel.

15. The handheld electronic device defined in claim 9 further comprising a display having a planar surface that is received within the bezel and wherein the bezel attaches the display to the housing.

16. The handheld electronic device defined in claim 9 further comprising a switch that bridges the slot.

* * * * *

UNITED STATES PATENT AND TRADEMARK OFFICE

CERTIFICATE OF CORRECTION

PATENT NO. : 7,843,396 B2
APPLICATION NO. : 12/564803
DATED : November 30, 2010
INVENTOR(S) : Robert J. Hill et al.

It is certified that error appears in the above-identified patent and that said Letters Patent is hereby corrected as shown below:

On the title page, item (57), under "Abstract", in column 2, line 4, delete "housing a" and insert -- housing using a --, therefor.

In column 9, line 64, delete "phonolic" and insert -- phenolic --, therefor.

In column 16, line 63, delete "54-1B.)." and insert -- 54-1B). --, therefor.

Signed and Sealed this
Twenty-fifth Day of October, 2011

David J. Kappos

David J. Kappos
*Director of the United States Patent and Trademark Office*